US010464702B2

(12) United States Patent
Bois et al.

(10) Patent No.: US 10,464,702 B2
(45) Date of Patent: Nov. 5, 2019

(54) FORM FILL AND SEAL MACHINE FOR A BAG INCLUDING A DRAWSTRING TAPE OR CORD AND METHOD FOR MANUFACTURING SUCH A BAG

(71) Applicant: S2F FLEXICO, Henonville (FR)

(72) Inventors: Henri Bois, Neuilly-sur-Seine (FR); Philippe Georges, Chantilly (FR); Stephen Buygnet, Bus la Mesiere (FR)

(73) Assignee: S2F FLEXICO, Henonville (FR)

( * ) Notice: Subject to any disclaimer, the term of this patent is extended or adjusted under 35 U.S.C. 154(b) by 336 days.

(21) Appl. No.: 15/311,164

(22) PCT Filed: May 13, 2015

(86) PCT No.: PCT/EP2015/060668
§ 371 (c)(1),
(2) Date: Nov. 14, 2016

(87) PCT Pub. No.: WO2015/173340
PCT Pub. Date: Nov. 19, 2015

(65) Prior Publication Data

US 2017/0073098 A1 Mar. 16, 2017

(30) Foreign Application Priority Data

May 15, 2014 (FR) ..... 14 54369

(51) Int. Cl.
*B65B 51/04* (2006.01)
*B65B 61/18* (2006.01)
(Continued)

(52) U.S. Cl.
CPC ..... *B65B 51/046* (2013.01); *B65B 9/08* (2013.01); *B65B 39/007* (2013.01); *B65B 51/22* (2013.01); *B65B 51/30* (2013.01)

(58) Field of Classification Search
CPC ..... B65B 51/00; B65B 51/046; B65D 33/165; B65D 33/28; B31B 70/8134–8137; Y10S 493/928
(Continued)

(56) References Cited

U.S. PATENT DOCUMENTS 2,897,729 A * 8/1959 Ashton et al. ..... B31B 70/00 156/459
3,058,402 A 10/1962 Kugler
(Continued)

FOREIGN PATENT DOCUMENTS

DE 42 44 024 A1 9/1994
DE 10215648 A1 * 11/2003 ..... B31B 70/00
(Continued)

OTHER PUBLICATIONS

International Search Report in PCT/EP2015/060668 dated Jul. 1, 2015, with English translation. 3 pages.
(Continued)

*Primary Examiner* — Stephen F. Gerrity
(74) *Attorney, Agent, or Firm* — Womble Bond Dickinson (US) LLP

(57) ABSTRACT

A form-fill-seal machine and a method for manufacturing and filling a bag (100) having a drawstring tape or cord. The form-fill-seal machine includes a device to guide a film on the machine. A conveying device positions at least one drawstring tape or cord on the film. A folding device folds the film to form a first sheet and a second sheet of the bag. First and second welding jaws weld the first sheet and the second sheet to close two sides of the bag and leave a third side of the bag open. A filling chute fills the bag by the third side of the bag. Third welding jaws close the bag by sealing the third side.

24 Claims, 15 Drawing Sheets

(51) Int. Cl.

| | |
|---|---|
| ***B65D 33/28*** | (2006.01) |
| ***B65B 9/08*** | (2012.01) |
| ***B65B 39/00*** | (2006.01) |
| ***B65B 51/22*** | (2006.01) |
| ***B65B 51/30*** | (2006.01) |
| ***B31B 70/81*** | (2017.01) |

(58) Field of Classification Search
USPC ..... 53/410, 412, 133.1, 133.3, 138.1, 138.6, 53/138.7, 139.4; 383/61.4, 72, 75, 76; 493/225, 928
See application file for complete search history.

(56) References Cited

U.S. PATENT DOCUMENTS 3,084,731 A * 4/1963 Kugler ..... B65D 33/02 493/225
3,119,549 A * 1/1964 Schoen ..... B65D 33/28 206/459.5
3,196,757 A * 7/1965 Samways ..... B65D 33/28 156/70
3,228,584 A * 1/1966 Ashton ..... B65D 33/28 383/13
3,283,994 A * 11/1966 Miller ..... B65D 33/28 383/107
3,859,895 A * 1/1975 White ..... B65D 33/30 493/225
3,982,687 A * 9/1976 Auer et al. ..... B65D 33/28 383/204
4,036,363 A * 7/1977 Kugler ..... B65B 43/36 206/526
4,354,335 A * 10/1982 Meyer ..... B65B 43/123 493/235
4,493,683 A * 1/1985 Jostler ..... B26D 7/01 493/225
5,036,643 A * 8/1991 Bodolay ..... B65B 61/188 53/133.1
5,797,828 A * 8/1998 Selle et al. ..... B31B 70/00 493/225
6,254,519 B1 * 7/2001 Toshima ..... B65D 75/5894 53/412
6,602,174 B1 * 8/2003 Haverfield et al. ..... B31B 1/64 493/225
2001/0019638 A1 * 9/2001 Fox et al. ..... B65D 33/02 383/75
2003/0228078 A1 * 12/2003 Clune et al. ..... A44B 18/0084 383/93
2005/0120678 A1 * 6/2005 Ausnit ..... B65B 9/093 53/412
2006/0185325 A1 * 8/2006 Buchman et al. .... B65B 61/188 53/412
2007/0065052 A1 * 3/2007 Ulas ..... A61F 15/001 383/72
2007/0271874 A1 * 11/2007 Leighton ..... A44B 19/42 53/412
2010/0098354 A1 * 4/2010 Fraser et al. ..... B65D 33/00 383/72
2010/0307114 A1 * 12/2010 Spiekers et al. ..... B65B 9/067 53/456
2012/0224795 A1 * 9/2012 Moehlenbrock ..... B65D 33/20 383/211
2013/0209005 A1 8/2013 Owensby et al.

FOREIGN PATENT DOCUMENTS

EP 0 432 114 A1 6/1991
EP 1500601 A1 * 1/2005 ..... B65D 33/28
EP 2 275 356 A1 1/2011
FR 1149418 A * 12/1957 ..... B65D 33/28
FR 1183880 A * 7/1959 ..... B65D 33/28
FR 2299962 A1 * 9/1976 ..... B65D 33/28
FR 2309419 A1 * 11/1976 ..... B65D 33/10
FR 2567103 A1 * 1/1986 ..... B65D 33/30
GB 2347137 A * 8/2000 ..... B65D 33/28
WO WO-8804635 A1 * 6/1988 ..... B65D 33/28

OTHER PUBLICATIONS

Search Report in French Application No. 1454369 dated Oct. 31, 2014, with English translation coversheet. 2 pages.

* cited by examiner

State of the art

State of the art

FORM FILL AND SEAL MACHINE FOR A BAG INCLUDING A DRAWSTRING TAPE OR CORD AND METHOD FOR MANUFACTURING SUCH A BAG

FIELD OF THE INVENTION

The present invention relates to the field of bags.

More precisely the present invention relates to the field of bags whereof the closing is ensured by pulling on drawstrings or cords.

In the rest of the description the term "cord" or "drawstring" will be used variously without this being considered as limiting. The term cord or drawstring such as used within the scope of the present patent application in particular covers any type of cord, drawstring, wire or equivalent means suitable for fulfilling the function corresponding to the present invention.

STATE OF THE ART

Many bags comprising a closing cord have already been proposed.

The appended FIGS. 1 and 2 for example respectively show, according to a perspective view and according to a transversal sectional view, a bag of this type known from the state of the art.

The appended FIG. 1 shows a bag 10 comprising two main sheets 12, 14.

The sheets 12 and 14 are overall rectangular and parallel to each other.

The sheets 12 and 14 are connected at a bottom 16 and two sides 17, 18 opposite each other, parallel to each other and perpendicular to the bottom 16, as well as an open mouth 19 opposite the bottom 16.

The bag 10 shown in FIG. 1 further comprises near the mouth 19 two series of parallel channels 30, 32 and 40, 42 respectively receiving a closing cord or drawstring 31, 33 and 41, 43.

A first series of channels comprises two parallel channels 30, 32 adjacent to the mouth 19 respectively on each of the two sheets 12, 14.

A second series of channels comprises two other channels 40, 42 parallel to each other, respectively on each of the two sheets 12, 14 set back from the mouth 19.

Each of the two channels 30, 32 of the above first series receives a cord strand 31, 33. These two cord strands 31, 33 are connected together by knots 35, 36 on either side of the sides of the bag 10, on the exterior of the bag 10.

Each of the channels 40, 42 of the second series receives a cord strand 41, 43. The two strands 41, 43 are connected together by knots 45, 46 on either side of the sides of the bag 10, on the exterior of the bag.

Pulling on respective opposite ends of the two sets of cords, for example by traction in opposite directions respectively on the knots 35 and 46 as shown in FIG. 1 by arrows referenced A and B, produces tightening, then the closing of the mouth 19 of the bag 10.

In theory, cord bags of the type illustrated in FIGS. 1 and 2 as appended present a real interest to the extent where in principle they enable simple opening and simple and reversible closing of the bags 10.

But, it is difficult to make these bags 10 simply and rapidly. It is in fact necessary, on the manufacturing line to knot together the strands 31 and 33, 41 and 43 so as to make knots. This knotting requires the use of specific machines and substantially slows cadence. Also, there is a considerable risk of having to shut down the manufacturing line at the knotters (which make the knots on the strands).

Also, knotting strands 31 and 33, 41 and 43 does not lead to automatic filling of bags 10. To fill such cord bags 10, it is in fact necessary to first guide a film on a form machine so as to form the bag 10 fitted with its cords whereof the strands 31, 33, 41, 43 are free, then guide this bag 10 to a knotter which makes the knots on the strands 31, 33, 41, 43, and finally guide the bag 10 with the strands 31, 33, 41, 43 now knotted on a fill machine. Form and fill machines are therefore necessarily separate, due to the need to knot the strands 31, 33, 41, 43 outside the filling chain.

Reference could be made especially to documents U.S. Pat. No. 3,058,402, DE 42 44 024 or also US 2013/209005 for more details on making and filling such bags.

It is also not possible to knot the strands 31, 33, 41, 43 after filling the bag 10.

Neither is it possible to deliver bags comprising non-knotted strands 31, 33, 41, 43. It is true that manufacturing cadence of bags could clearly be increased, but the strands would be likely to exit from their respective channel 30, 32, 40, 42 during handling of the bags.

SUMMARY OF THE INVENTION

An aim of the invention is therefore to improve known methods and machines so as to enable forming, filling and sealing of bags of drawstring packaging, which are simple and easy to execute, and improve the manufacturing cadence of cord bags, at a lower manufacturing cost.

For this purpose, the invention proposes a form, fill and seal machine for manufacturing and filling a drawstring bag, said bag comprising a first sheet and a second sheet forming together a first edge and a second edge of the bag, and a drawstring closing device, the form-fill-seal machine comprising:

- a device configured to guide a film on the machine,
- a conveying device configured to position at least one drawstring on the film,
- a folding device configured to fold the film so as to form the first sheet and the second sheet of the bag,
- first and second welding jaws configured to weld the first sheet and the second sheet so as to close two sides of the bag and leave a third side of the bag open,
- a filling chute configured to fill the bag by the third side of the bag, and
- third welding jaws configured to close the bag by sealing the third side.

Some preferred but non-limiting characteristics of the machine described hereinabove are the following:

- the conveying device is configured to position two drawstrings on the film, said drawstrings extending substantially parallel relative to each other,
- the machine further comprises a device configured to form a channel configured to receive the drawstring, by fastening a strip welded above the drawstring or by folding and welding of the film above the drawstring,
- the conveying device is configured to position the drawstring in a direction transversal to a travel direction of the film.
- the folding device comprises a former, the first welding jaws are configured to weld the first edge of the bag, and the second and third welding jaws are combined and configured to weld successively the bottom and the mouth of the bag, the conveying device is configured to position two drawstrings on the film, said drawstrings extending substantially parallel relative to each other, the conveying device is configured to position the drawstrings on the film such that the first drawstring is adjacent to a first side of the film and the second drawstring is adjacent to a second side of the film, the first drawstring and the second drawstring being of length substantially equal to half the width of the film, such that the first drawstring and the second drawstring are substantially offset relative to each other in a direction perpendicular to the travel direction of the film, the machine further comprises a device configured to form a first notch in the first side of the film in a zone of the film intended to receive the first drawstring, and a second notch in a central zone of the film, in a zone of the film intended to receive the second drawstring, such that during folding of the film by the folding device, the first notch is located at the first edge of the bag and the second notch is located at the second edge of the bag, the machine further comprises fourth welding jaws configured to weld the first drawstring on the second edge of the bag and the second drawstring on the first edge of the bag, the conveying device is configured to position the drawstring on the film such that said drawstring protrudes on either side of said film, and the folding device is configured to fold the film such that the free ends of the drawstring are adjacent, the folding device is configured to form the second edge of the bag, and the first and the second welding jaws are combined and configured to weld successively the bottom and the mouth of the bag, and the third welding jaws are configured to weld the first edge of the bag, the machine further comprises fourth welding jaws configured to weld the drawstring to the film at a zone of the film intended to form the second edge of the bag, so as to weld the drawstring both on the second sheet and on the first sheet, the machine further comprises fourth welding jaws configured to weld the drawstring to the film in a zone of the film intended to form the first edge of the bag, the drawstring not being fixed on the second sheet, the fourth welding jaws and the first welding jaws or the third welding jaws are combined and are configured to weld the drawstring on the first sheet at the first edge of the bag, the drawstring not being fixed on the second sheet, the conveying device is configured to position two drawstrings on the film, said drawstrings extending substantially parallel relative to each other in the travel direction of the film, such that the first drawstring is adjacent to a first side of the film and the second drawstring is adjacent to a second side of the film, the folding device comprises a former, the first welding jaws are configured to weld the mouth of the bag, and the second and the third welding jaws are combined and are configured to weld successively the first edge of the bag and the second edge of the bag, the folding device is configured to form the bottom of the bag, and the first and the second welding jaws are combined and are configured to weld successively the first edge and the second edge of the bag, and the third welding jaws are configured to weld the mouth of the bag, the machine further comprises fourth welding jaws configured to weld the first drawstring on the second edge of the bag and the second drawstring on the first edge of the bag, the machine further comprises fourth welding jaws configured to weld the first drawstring and the second drawstring together, the machine further comprises fourth welding jaws configured to weld the first drawstring and the second drawstring on the second edge of the bag, the machine further comprises fourth welding jaws configured to weld the first drawstring in a zone at a distance from the second edge of the bag and the second drawstring in a zone at a distance from the first edge of the bag, the fourth welding jaws are combined with the first or the second welding jaws or are combined with the second or the third welding jaws.

According to a second aspect, the invention also proposes a method for manufacturing and filling a drawstring bag by means of a form-fill-seal machine as described hereinabove, said bag including a first sheet and a second sheet forming together a first edge and a second edge of the bag, and a drawstring closing device, the manufacturing and filling method comprising the following steps:

guiding a film on the machine, positioning at least one drawstring on the film, folding the film so as to form the first sheet and the second sheet of the bag, welding the first sheet and the second sheet so as to close two sides of the bag and leave a third side of the bag open, filling the bag by the third side of the bag, and closing the bag by sealing the third side.

Some preferred but non-limiting characteristics of the manufacturing and filling method described hereinabove are the following:

two drawstrings are positioned on the film, said drawstrings extending substantially parallel relative to each other, a channel configured to receive the drawstring is formed by fastening a strip welded above the drawstring or by folding and welding of the film above the drawstring, the drawstring is positioned in a direction transversal to a travel direction of the film, the film is folded so as to form the second edge of the bag, the first and the second sheet are welded so as to form the first edge and the bottom of the bag, and the bag is closed by sealing the mouth of the bag, two drawstrings are positioned on the film, said drawstrings extending substantially parallel relative to each other, the drawstrings are positioned on the film such that the first drawstring is adjacent to a first side of the film and the second drawstring is adjacent to a second side of the film, the first drawstring and the second drawstring being of length substantially equal to half the width of the film, such that the first drawstring and the second drawstring are substantially offset relative to each other in a direction perpendicular to the travel direction of the film, a first notch is formed in the first side of the film in a zone of the film intended to receive the first drawstring, and a second notch is formed in a central zone of the film, in a zone of the film intended to receive the second drawstring, such that during folding of the film, the first notch is located at the first edge of the bag and the second notch is located at the second edge of the bag, the first drawstring is welded on the second edge of the bag and the second drawstring is welded on the first edge of the bag, the drawstring is positioned on the film such that said drawstring protrudes on either side of said film, and the film is folded such that the free ends of the drawstring are adjacent, the film is folded so as to form the second edge of the bag, and the first and the second sheet are welded so as to form the bottom and the mouth of the bag, and the bag is closed by sealing the first edge of the bag, the drawstring is welded to the film at a zone of the film intended to form the second edge of the bag, so as to weld the drawstring both on the second sheet and on the first sheet, the drawstring is welded to the film in a zone of the film intended to form the first edge of the bag, the drawstring not being fixed on the second sheet, the welding of the drawstring occurs simultaneously with welding of the first and of the second sheet so as to weld the drawstring on the first sheet at the first edge of the bag, the drawstring not being fixed on the second sheet, two drawstrings are positioned on the film, said drawstrings extending substantially parallel relative to each other in the travel direction of the film, such that the first drawstring is adjacent to a first side of the film and the second drawstring is adjacent to a second side of the film, the film is folded so as to form the bottom of the bag, the first and the second sheet are welded so as to form the mouth and the second edge of the bag, and the bag is closed by sealing the first edge of the bag.

the film is folded so as to form the bottom of the bag, and the first and the second sheet are welded so as to form the first and the second edge of the bag, and the bag is closed by sealing the mouth of the bag.

the first drawstring is welded on the second edge of the bag and the second drawstring is welded on the first edge of the bag, the first drawstring and the second drawstring are welded together, the first drawstring and the second drawstring are welded on the second edge of the bag, the first drawstring is welded in a zone at a distance from the second edge of the bag and the second drawstring is welded in a zone at a distance from the first edge of the bag, the welding of the first and of the second drawstring occurs simultaneously with welding of the first and of the second sheet or with welding of the first and of the second sheet and with closing of the bag.

BRIEF DESCRIPTION OF THE DRAWINGS

Other characteristics, aims and advantages of the present invention will emerge from the following detailed description and with respect to the appended drawings given by way of non-limiting examples and in which.

DETAILED DESCRIPTION OF AN EMBODIMENT

In reference to the appended figures two embodiments of the invention will be described.

The first embodiment relates to a method for manufacturing a cord bag 100 on a form, fill and seal machine wherein the closing device 120 is received in the transversal direction, i.e., perpendicularly to the travel direction of the film in the machine.

The second embodiment as such relates to a method for manufacturing a cord bag 100 on a form, fill and seal machine in which the closing device 120 is received in a longitudinal direction, i.e., parallel to the travel direction of the film in the machine.

First Embodiment: Transverse Fastening of the Closing Device 120

Figure 2:
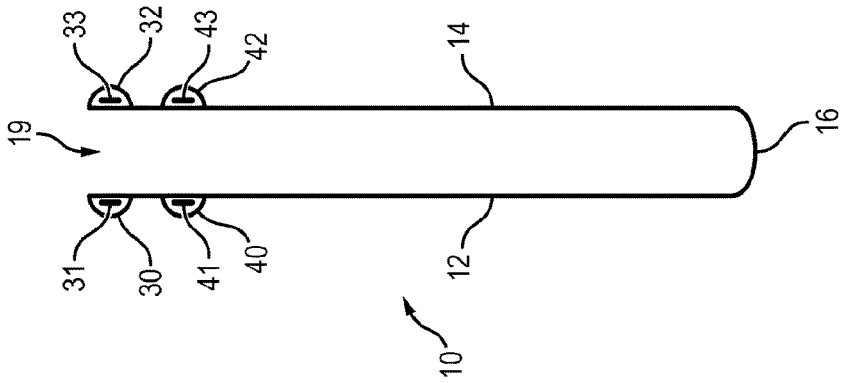
FIGS. 1 and 2 previously described illustrate an outer perspective view of a bag according to the state of the art, and a view in transversal section of the same bag known from the state of the art.
Figure 1:
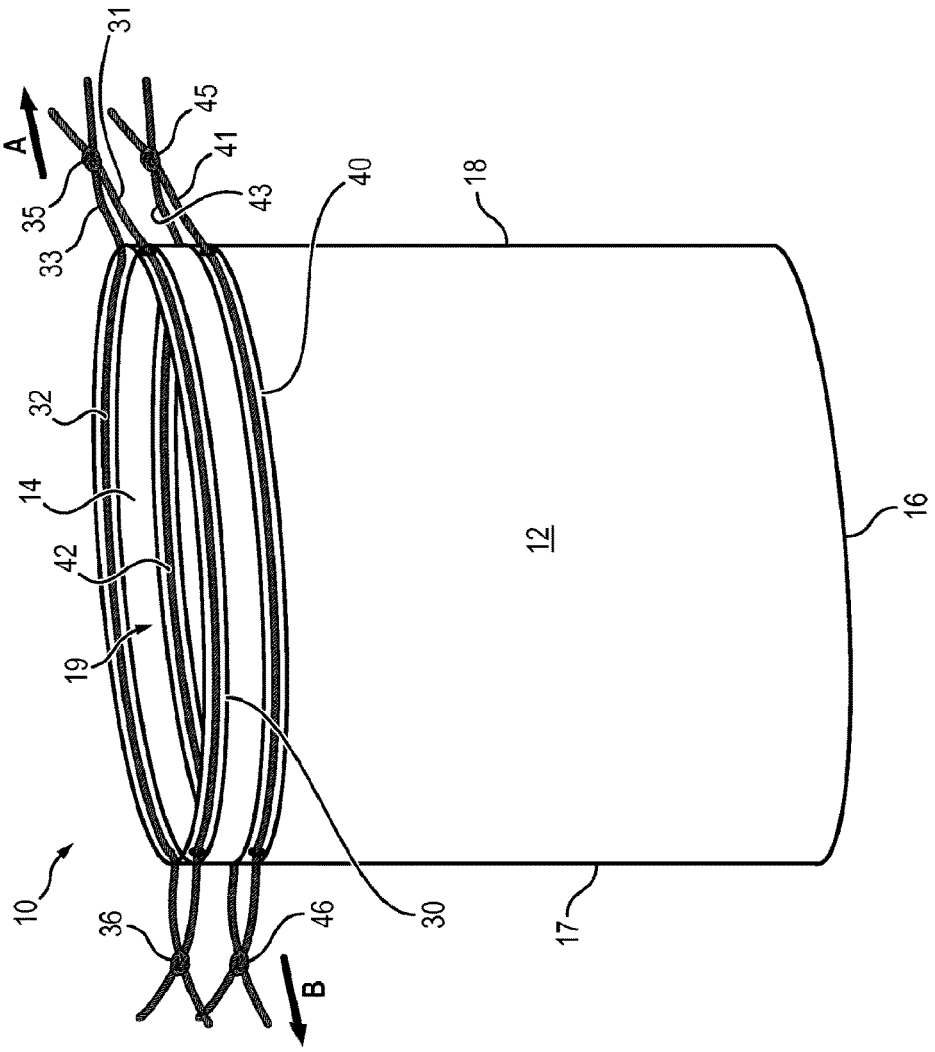
Figure 3B:
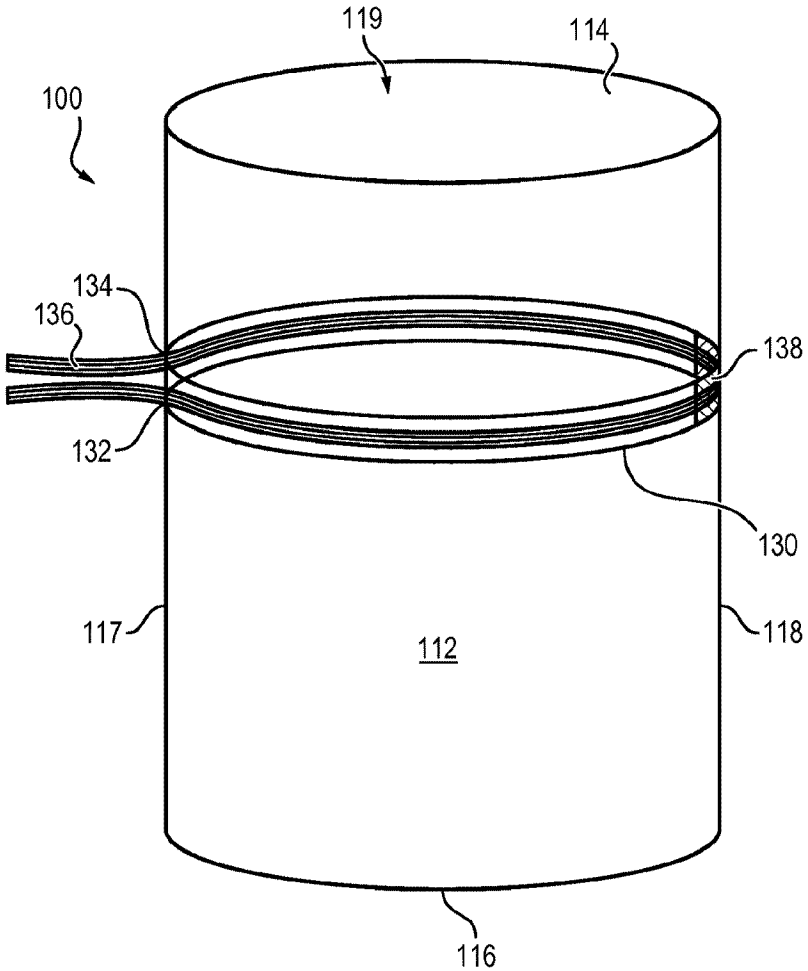
FIGS. 3*a* to 3*e* illustrate different examples of bags obtained by means of a form-fill-seal machine according to a first embodiment the invention.
Figure 3A:
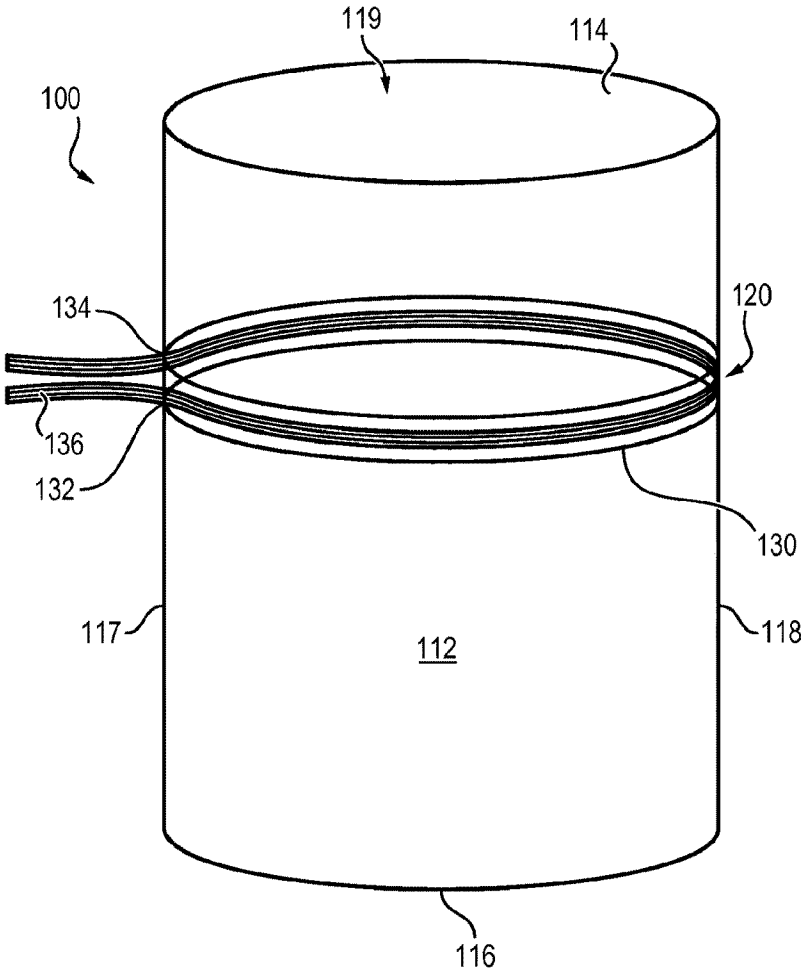
Figure 3D:
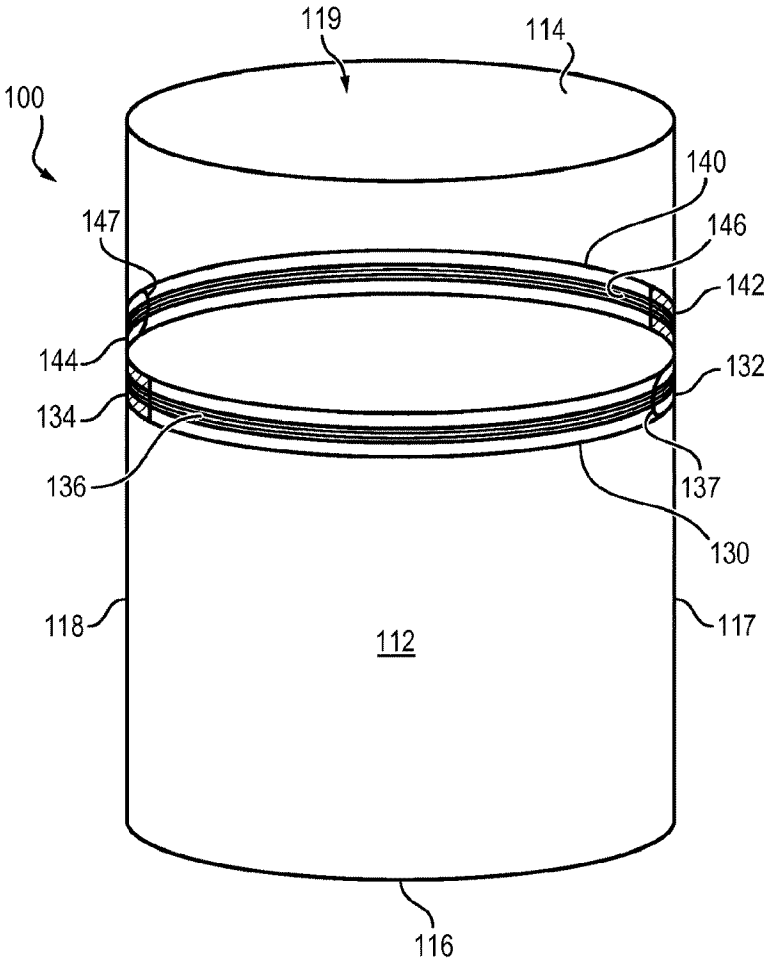
Figure 3C:
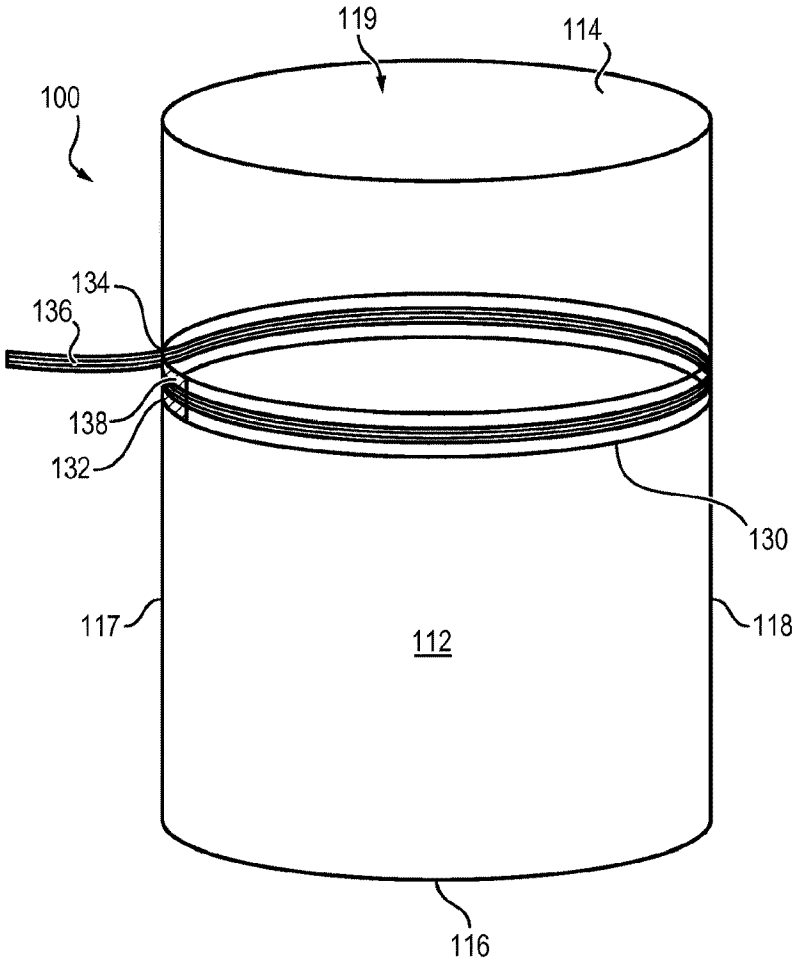
Figure 3E:
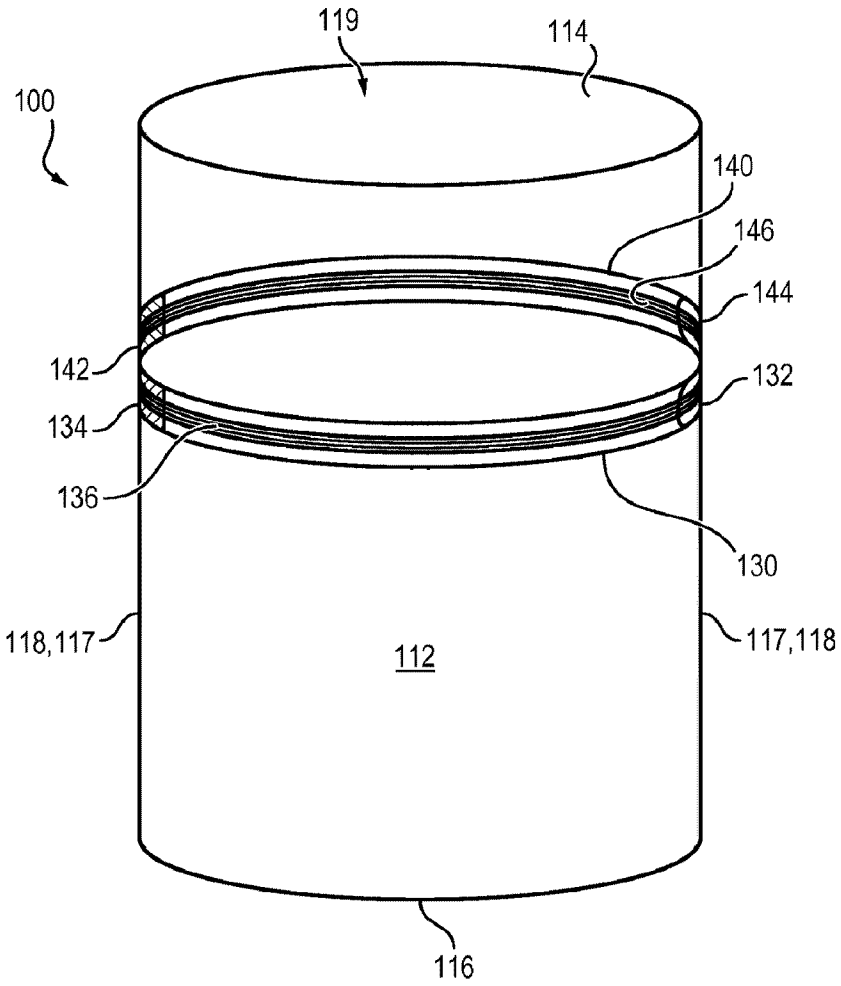
Figure 4:
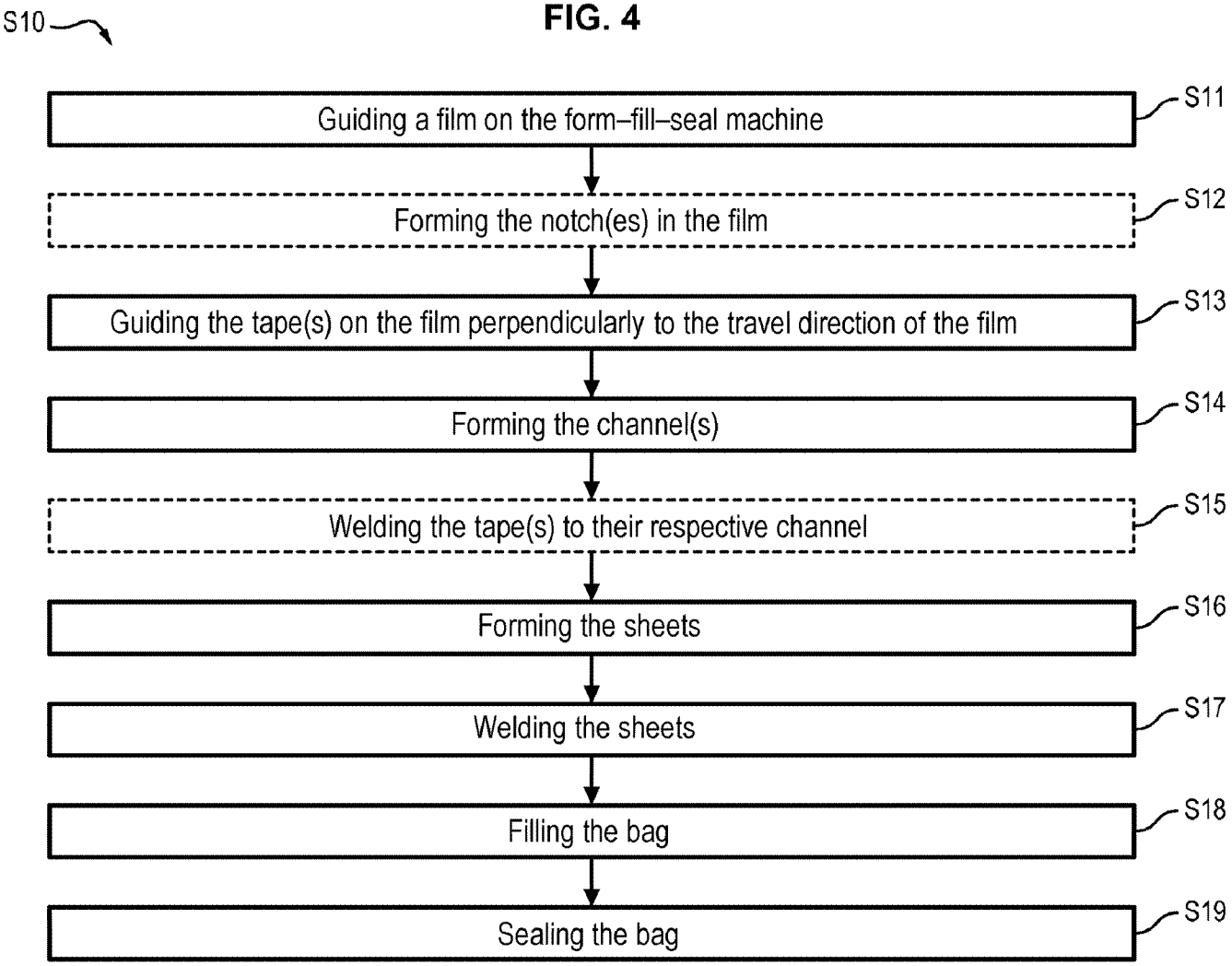
FIG. 4 illustrates a flowchart of a method for implementing the form-fill-seal machine according to the first embodiment of the invention.

FIGS. 3 to 5 illustrate several examples of drawstring bag 100, a method S10 for manufacturing and filling of a drawstring bag 100, and a form-fill-seal machine 200, 300 according to a first embodiment of the invention.

Examples of Drawstring Bag 100 According to the First Embodiment

FIGS. 3*a* to 3*e* illustrate examples of drawstring bags 100 which may be obtained according to a method S10 for manufacturing and filling of a drawstring bag 100 according to the first embodiment of the invention.

The bag 100 comprises a first sheet 112 and a second sheet 114 parallel and adjacent at rest, and attached together so as to form sides. Each of the sides of the first and second sheets 112, 114 corresponds to a bottom 116, two lateral edges 117, 118 parallel to each other and orthogonal to the bottom 116 and a mouth 119 parallel to the bottom 116 and orthogonal to the lateral edges 117, 118.

The material making up the film 1 is preferably heat-sealable material, especially thermoplastic material which may be welded. The plastic material may especially belong to the family of polyolefins and may comprise at least one among the following materials: polyethylene, polypropylene, low-density polyethylene, high -density polyethylene, or a copolymer of these monomers.

The sheets 112, 114 may be transparent. They may however be provided with any appropriate printing or decoration.

The sheets 112, 114 may be also made based on composite material by incorporating for example paper and/or metal sheets, for example in a sandwich structure. In this exemplary embodiment, the film 1 in the composite material comprises an inner face 113 formed in heat-sealable material, especially thermoplastic material. The plastic material may especially belong to the family of polyolefins and comprise at least one among the following materials: polyethylene, polypropylene, low-density polyethylene, high-density polyethylene, or a copolymer of these monomers.

The sheets 112, 114 are selected from material and thickness to ensure sufficient flexibility to the bag to allow its closing by swaging of a mouth 119 opposite the bottom 116. The sheets 112, 114 are therefore flexible.

In a first embodiment illustrated in FIGS. 3*a* to 3*c*, the bag 100 further comprises a closing device 120 comprising:

- a channel 130 extending along the two sheets 112, 114 of the bag 100 between the edges 117, 118, the channel 130 comprising a first end 132 and a second end 134 adjacent to the first edge 117, and
- a drawstring 136, housed in the channel 130 between the first end 132 and the second end 134 such that the two free ends of the drawstring 136 are flush with the channel 130 at the same edge 117 of the bag 100 and thus forms a loop. The drawstring 136 further projects from one at least of the ends 132, 134 of the channel 130.

Closing of the bag 100 is therefore done by pulling on the free ends of the drawstring 136 in the extension of the channel 130, in the same direction, by gripping the first edge 117 of the bag at which the drawstring 136 protrudes.

In the example illustrated in FIG. 3*a*, the drawstring 130 is left free to slide in the channel 130. It is clear that the loop formed by the drawstring 136 in its channel 130 limits the risk of the drawstring 136 not coming out of the channel 130, without needing to form a knot at its free ends.

According to a variant illustrated in FIGS. 3*b* and 3*c*, the drawstring 136 is welded to the channel 130. The drawstring 136 is for example welded to the channel 130 in a zone adjacent to the second edge 118 of the bag 100, as illustrated in FIG. 3*b*. In this example, the drawstring 136 is therefore welded in a zone extending overall at mid-distance from the ends 132, 134 of the channel 130. The drawstring 136 may therefore be welded either directly at the second edge 118, or at a short distance from the second edge 118. The drawstring 136 may also be welded to the channel 130 in a zone adjacent to the first end 132 of said channel 130, as illustrated in FIG. 3*c*. The drawstring 136 may be welded either directly at the first end 132 of the channel 130, or at a short distance from the first end 132. Here too, it is clear that welding 138 of the drawstring 136 to the channel 130 blocks the drawstring 136 in the channel 130 without needing to form a knot at its free ends.

In the examples illustrated in FIGS. 3*a* to 3*c*, the drawstring 136 protrudes from the first edge 117 of the channel 130. As a variant, the free ends 132, 134 of the drawstring 136 may also be welded together at their part protruding from the ends 132, 134 of the channel 130. In this case the length of the drawstring 136 may correspond overall to the length of the channel 130.

The bag 100 may also be provided with a notch 137 (or clearances) made at the ends 132, 134 of the channel 130 from which the drawstring 136 protrudes. The length of the drawstring 136 may be substantially equal to that of the channel 130, and offer easy handling by a user.

In a second embodiment illustrated in FIGS. 3*d* and 3*e*, the bag 100 comprises a closing device 120 comprising:

- a first channel 130 and a second channel 140 extending between the edges 117, 118 of the bag, respectively on the first and the second sheet 112, 114 of the bag 100, the first channel 130 and the second channel 140 each comprising a first end 132, 142 and a second end 134, 144, and
- a first drawstring 136, housed in the first channel 130, and a second drawstring 146, housed in the second channel 140, the first drawstring 136 protruding from the first end 132 of the first channel 130 and the second drawstring 146 protruding from the second end 144 of the second channel 140.

The first drawstring 130 is welded in a zone adjacent to the second end 134 of the first channel 130 and the second drawstring 146 is welded in a zone adjacent to the first end 142 of the second channel 140. The drawstrings 136, 146 may be welded either directly at the free ends 132, 144 respectively, or at a short distance from these free ends 132, 144.

In the example illustrated in FIG. 3*d*, the first end 132 of the first channel 130 and the first end 142 of the second channel 140 are adjacent to the first edge 117 of the bag 100. In this way, the first drawstring 136 and the second drawstring 146 protrude from their respective channel 130, 140 at an edge 117, 118 opposite the bag 100. Closing of the bag 100 is therefore done by pulling on the drawstrings 136, 146 in the extension of their respective channel 130, 140, in opposite directions. Those skilled in the art will understand that pulling on the emerging ends of each of the drawstrings 136, 146 easily achieves closing of the mouth 119.

As a variant illustrated in FIG. 3*e*, the first end 132 of the first channel 130 and the second end 144 of the second channel 140 are adjacent to the same edge 117 or 118 of the bag 100. In this way, the first drawstring 136 and the second drawstring 146 protrude from their respective channel 130, 140 at the same edge 117 or 118 of the bag 100. Closing of the bag 100 is therefore done by pulling on the drawstrings 136, 146 in the extension of their respective channel 130, 140, in the same direction. Those skilled in the art will understand that pulling on the emerging ends of each of the drawstrings 136, 146 by gripping the first edge 117 of the bag at which the drawstrings 136, 146 protrude easily achieves closing of the mouth 119.

The first channel 130 and the second channel 140 may be offset relative to each other according to the height of the bag 100, i.e., the second channel 140 may be closer to the mouth 119 of the bag 100 than the first channel 130, such that they are not superposed when the bag 100 is flattened. As a variant, the first and the second channel 130, 140 are not offset relative to each other according to the height of the bag 100, such that they are not superposed when the bag 100 is flattened.

In this second embodiment, the drawstrings 136, 146 do not project from the edges 117, 118 of the bag 100. The length of the drawstrings 136, 146 corresponds overall to the length of their respective channel 130, 140.

The bag 100 may further be provided with notches 137, 147 (or clearances) made at the ends 132, 144 of the channels 130, 140 from which the first and second drawstrings 136, 146 protrude. The length of the drawstring 136 may be substantially equal to that of the channel 130, and make for easy handling by a user.

Irrespective of the embodiment, the closing device 120 may be made at the mouth 119 or at a distance from the latter. For example, the closing device 120 may extend in the first quarter of the bag 100, typically two, preferably three centimeters from the mouth 119.

The drawstring(s) 136, 146 may be made in heat-sealable material, typically polyolefin comprising a polymer or a copolymer among the following materials: polypropylene and its copolymers, polyethylene and its copolymers, high-density polyethylene, low-density polyethylene. In this way during welding of the drawstring(s) 136, 146 onto the channel 130 or to their respective channel 130, 140, the end of the drawstring(s) 136, 146 melts and forms a solid junction with the channel 130 or their respective channel 130, 140.

In this case, for welding 138 of the drawstring(s) 136, 146 on the bag 100, the drawstring(s) 136, 146 may be made of material compatible with the material comprising the sheets 112, 114. For this purpose, the sheets 112, 114 (or at least their inner layer) and the drawstring(s) 136, 146 may especially be made of identical or similar material. For example, the sheets 112, 114 and the drawstring(s) 136, 146 may be made of polyethylene or polypropylene.

As a variant, the drawstring(s) 136, 146 are formed in non-fusible material (such as cotton or polyester for example), i.e., a material whereof the melting temperature is greater than the welding temperatures applied to the matter of the bag 100. The effect of fastening by welding 138 of the drawstring(s) 136, 146 to the channel 130 or to their respective channel 130, 140 is to mechanically trap the drawstring(s) 136, 146 in the welding 138. Welding 138 the channel(s) 130, 140 produces a shearing effect of the drawstring(s) 136, 146 to form connection points between the bag 100 and the drawstring(s) 136, 146.

Method S10 for Manufacturing and Filling a Drawstring Bag 100 According to the First Embodiment The bags 100 according to the first embodiment may be obtained on a so-called horizontal 200 (FIG. 5*a*) or vertical 300 (FIGS. 5*b* to 5*d*) machine according to a manufacturing method S10 comprising the following steps.

During a first step S11, a film 1 intended to form the sheets 112, 114 of the bag 100 is guided on a form-fill-seal machine 200.

During a second step S12, optional, notches 137, 147 may be formed on the film 1, in the zone of the film 1 intended to receive the end(s) 132, 134 of the channel 130 or the ends 132, 144 of the channels 130, 140 from which the drawstrings 136, 146 protrude.

In the variant corresponding to the second embodiment, the zone intended to receive the ends 132, 144 of the channels 130, 140 may especially comprise one of the edges of the film and a central part of the film (for the bag of FIG. 3*d* for example), or the two edges of the film (for the bag of FIG. 3*e* for example). In this latter case, on completion of the method S10, the drawstrings 136, 146 will project from the first edge 117 of the bag 100. The zone intended to receive the ends 132, 144 of the channels 130, 140 may further comprise only a central part of the film (for the bag of FIG. 3*e* for example). In this latter case, on completion of the method S10, the drawstrings 136, 146 will project from the second edge 118 of the bag 100. The notches 137, 147 may be offset one relative to the other in the travel direction of the film 1, or else form only a single notch from which the drawstrings 136, 146 both protrude.

During a third step S13, a drawstring 136 is guided on the film 1, perpendicularly to a travel direction of the film 1. If needed, the drawstring 136 is placed on the film 1 such that a free end of the drawstring 136 is positioned at the notch 137.

In a variant corresponding to the second embodiment, during the third step S13, a second drawstring 146 is also guided on the film 1, perpendicularly to a travel direction of the film 1, if needed at the second notch 147. The first and second drawstrings 136, 146 are positioned offset relative to each other in the direction perpendicular to the travel direction of the film 1. The first drawstring 136 extends for example from a first side of the film 1 to a central zone of the film 1, whereas the second drawstring 146 extends from the central zone of the film 1 to a second side of the film 1. The first and second drawstrings 136, 146 may also be positioned offset relative to each other in the travel direction of the film 1.

During a fourth step S14, a strip 139 or strips 139, 149 intended to form the channel 130 or the channels 130, 140 are attached and welded on the film 1, above the drawstring 136 or the drawstrings 136, 146 such that the channel 130 or the channels 130, 140 extend perpendicularly to the travel direction of the film 1.

During a fifth step S15, optional, the drawstring 136 or the drawstrings 136, 146 may be welded to the channel 130 or to their respective channel 130, 140.

According to the first embodiment, the drawstring 136 may for example be welded to the channel 130 in a zone adjacent to one 132 of the ends of the channel 130. As a variant, the drawstring 136 may be welded to the channel 130 in a zone extending overall at mid-distance from the ends 132, 134 of the channel 130. According to yet another variant, the drawstring 136 is left free to slide in the channel 130.

According to the second embodiment, the first drawstring 136 is welded in a zone adjacent to the second end 134 of the first channel 130 and the second drawstring 146 is welded in a zone adjacent to the first end 142 of the second channel 140.

During a sixth step S16, the film 1 fitted with the drawstring 136 or drawstrings 136 is folded back on itself, along a folding line extending in the travel direction of the film 1, so as to form the first and the second sheets 112, 114. The folding line defines the second edge 118 of the bag 100.

Figure 5A:
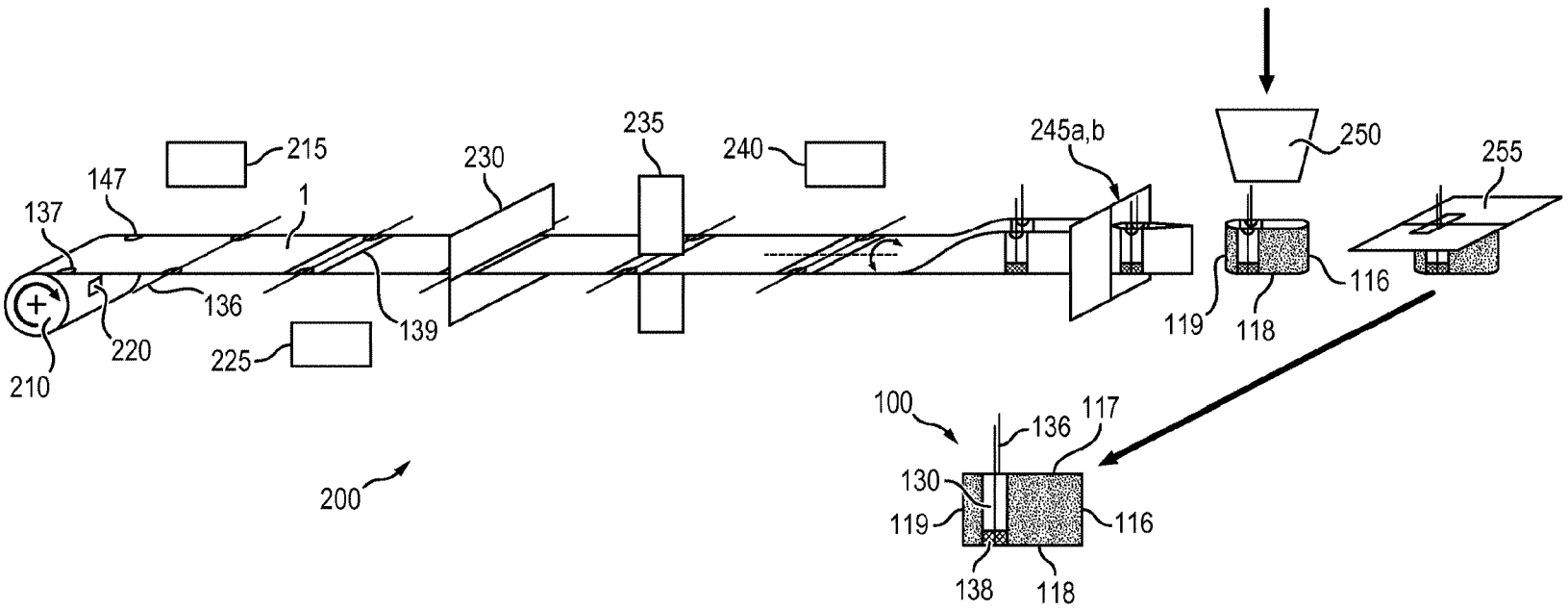
FIG. 5*a* illustrates a first example of a form-fill-seal machine according to the first embodiment of the invention.
Figure 5B:
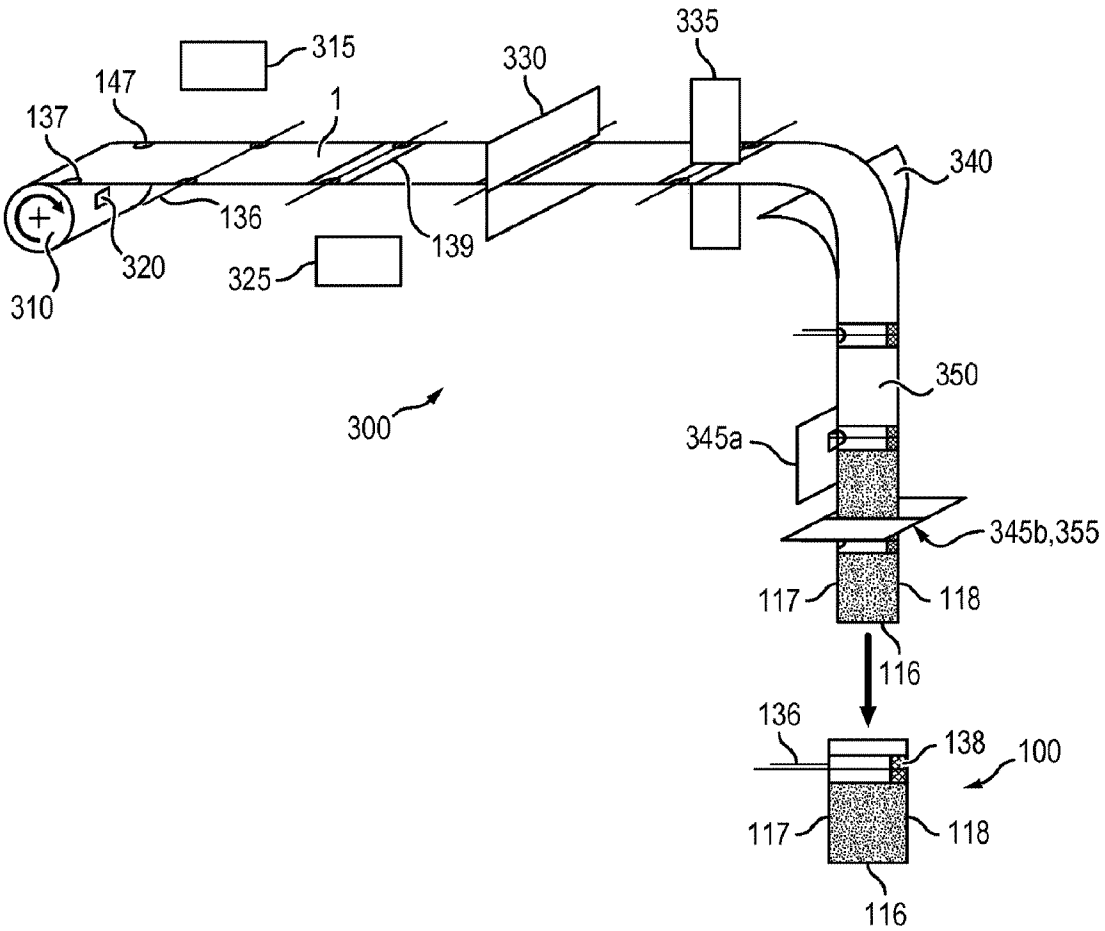
FIG. 5*b* illustrates a second example of a form-fill-seal machine according to the first embodiment of the invention.
Figure 5C:
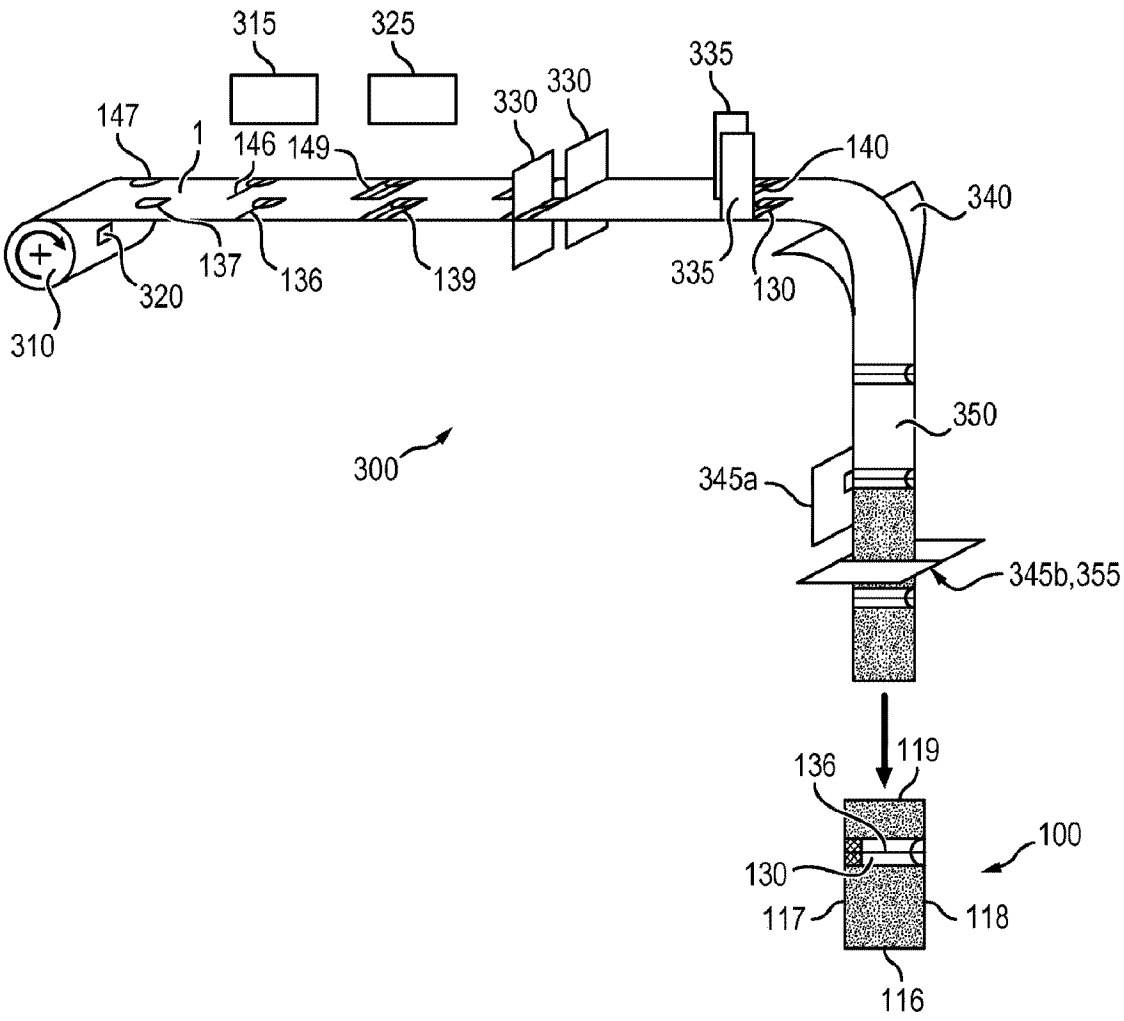
FIGS. 5*c* and 5*d* illustrate variants of the second example of a form-fill-seal machine according to the first embodiment of the invention.
Figure 5D:
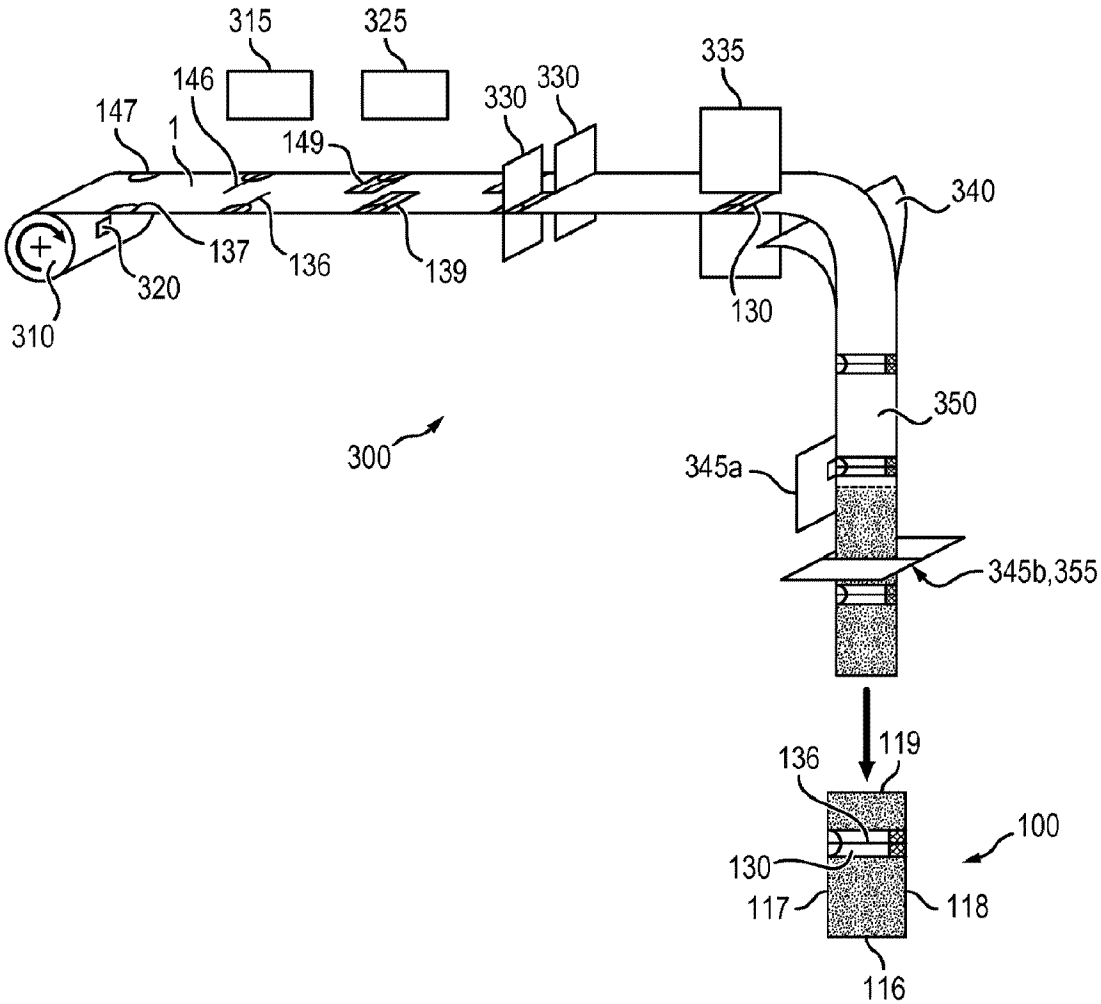

In the second exemplary embodiment illustrated in FIGS. 5*b* to 5*d*, wherein the form-fill-seal machine 300 is vertical, the film 1 is guided to a former to fold back the film 1 on itself.

At this stage, the bag 100 is open at three of these sides.

During a seventh step S17, the first and the second sheet 112, 114 are welded together so as to close two of the three open sides of the bag 100.

In the first exemplary embodiment illustrated in FIG. 5*a*, the first and the second sheet 112, 114 are welded together, the welding forming the bottom 116 of a first bag 100 and the mouth 119 of the bag 100 downstream. The first and second sheets 112, 114 are therefore welded together twice so as to seal the bottom 116 and the mouth 119 of the bag 100. At this stage of the method illustrated in FIG. 5*a*, the obtained bag 100 has a bottom 116 and a sealed mouth 119, an edge 118 closed by folding, as well as an open edge 117. The mouth 119 is further equipped with a drawstring 136 housed in a channel 130 and optionally welded to said channel 130.

In the second exemplary embodiment illustrated in FIGS. 5*b* to 5*d*, the first and the second sheet 112, 114 are welded together, along a longitudinal weld forming the first edge 117 of the bag 100 in a direction parallel to the travel direction of the film, then along a transverse weld forming the bottom 116 of the bag 100 in a direction perpendicular to the direction of the film 1. In this second example, the longitudinal weld of the first and second sheets 112, 114 may further weld the drawstring 136 to itself at the ends 132, 134 of the channel 130 or weld the drawstring 136 to the first edge 117 of the bag 100 without fixing it to the second sheet 114 (for the bag 100 of FIG. 3*c*) or weld the drawstrings 136, 146 to the first edge 117 of the bag 100 (for the bag 100 of FIG. 3*e*). The transverse weld of the first and second sheets 112, 114 together further seals the mouth 119 of the downstream bag 100. At this stage of the method illustrated in FIGS. 5*b* to 5*d*, the obtained bags 100 then have a bottom 116 and sealed edges 117, 118, as well as an open mouth 119. The mouth 119 is further equipped with one or more drawstrings 136 housed in a channel 130, 140 and optionally welded to said channel 130, 140.

The sixth and seventh steps S16, S17 thus form the bag 100.

During an eighth step S18, the bag 100 is filled via the last of the sides of the bag 100 still open. In the first exemplary embodiment (FIG. 5*a*), the bag 100 is filled via the side intended to form the first edge 117 of the bag 100, whereas in the second exemplary embodiment (FIG. 5*b*), the bag 100 is filled via the side intended to form the mouth 119 of the bag 100.

During a ninth step S19, the first and the second sheet 112, 114 may be welded together so as to close the last of the sides of the bag 100 still open and thus seal the bag 100. In the first exemplary embodiment (FIG. 5*a*), the first and the second sheet 112, 114 are welded together so as to form the first edge 117 of the bag 100. If needed, welding S19 of the first and second sheets 112, 114 may further weld the drawstring 136 to itself at the ends 132, 134 of the channel 130 or weld the drawstring 136 to the first edge 117 of the bag 100 without fixing it to the second sheet 114 (for the bag 100 of FIG. 3*c*). In the second exemplary embodiment (FIGS. 5*b* to 5*d*), the first and the second sheet 112, 114 are welded together so as to form the mouth 119 of the bag 100.

This produces a bag 100 comprising one or two drawstrings 136, 146 at least partly protruding from the channel (s) 130, 140 so as to enable multiple opening and closing. The bag 100 is further filled and sealed.

Form-Fill-Seal Machine 200, 300 According to the First Embodiment

The bags 100 according to the first embodiment may be obtained by means of a form-fill-seal machine 200, 300 comprising:

- a device 210, 310 configured to guide a film 1 on the form-fill-seal machine 200, 300,
- a conveying device 215, 315 configured to guide a drawstring 136 on the film 1 (see FIGS. 5*a* and 5*b*) perpendicularly to a travel direction of the film 1. In a variant corresponding to the second embodiment, the conveying device 315 is further configured to guide a second drawstring 146 on the film 1 (see FIGS. 5*c* and 5*d*), perpendicularly to the travel direction of the film 1 such that the first and the second drawstring 136, 146 extend substantially parallel relative to each other. The conveying device 315 may also be configured to position the first and second drawstrings 136, 146 offset relative to each other in the travel direction of the film 1 and in the direction perpendicular to the travel direction of the film 1,
- a device 225, 325 configured to form the channel 130 or the first channel 130 and the second channel 140 on the film 1, especially to apply a strip 139 or strips 139, 149 intended to form the channel 130 or the channels 130, 140 to the film 1, above the drawstring 136 or the drawstrings 136, 146, such that the channel 130 or the channels 130, 140 extend perpendicularly to the travel direction of the film 1,
- welding bars 230, 330 configured to weld the channel 130 or the first channel 130 and the second channel 140 on the film 1, especially to weld the strip 139 or the strips 139, 149 attached on the film 1, above the drawstring 136 or the drawstrings 136, 146,
- a folding device 240, 340 to fold back the film 1 on itself, along a folding line extending in the travel direction of the film 1, so as to form the first 112 and the second 114 sheet. In particular in the second exemplary embodiment illustrated in FIGS. 5*b* to 5*d*, the folding device 340 comprises a former,
- first and second welding jaws 245*a*, 245*b*; 345*a*, 345*b* configured to weld the first sheet 112 on the second sheet 114 and respectively form the first and second edges 117, 118 (FIG. 5*a*) or the first edge 117 and the bottom 116 (FIGS. 5*b* to 5*d*),
- a filling chute 250, 350 configured to fill the bag 100 by the side still open, and
- third welding jaws 255, 355 configured to seal the bag 100 by closing the side still open.

In the case of the method illustrated in FIG. 5*a*, the first and second welding jaws 245*a*, 245*b* may be combined and configured to weld successively the bottom 116 and the mouth 119 of the bag 100 due to travel of the bag 100 in the machine 200.

In the case of the method illustrated in FIGS. 5*b* to 5*d*, the second and third welding jaws 345*b*, 355 may be combined and configured to weld successively the bottom 116 and the mouth 119 of the bag 100 due to travel of the bag 100 in the machine 300.

Optionally, the form-fill-seal machine 200, 300 may comprise fourth welding jaws 235, 335 configured to weld the drawstring 136 to the channel 130 or the first drawstring 136 to the first channel 130 and the second drawstring 146 to the second channel 140.

In the case of the method illustrated in FIG. 5*a*, the fourth welding jaws 235 may be combined with the third welding jaws 255 and configured to weld the drawstring 136 on the first sheet 112 at the first edge 117 of the bag 100, without welding the drawstring 136 on the second sheet 114. This especially produces a bag 100 as illustrated in FIG. 3*c*.

In the case of the method illustrated in FIG. 5*b*, the fourth welding jaws 335 may be combined with the first welding jaws 345*a* and configured to weld the drawstring 136 on the first sheet 112 at the first edge 117 of the bag 100, without welding the drawstring 136 on the second sheet 114. This especially produces a bag 100 as illustrated in FIG. 3*c*.

As a variant of the method illustrated in FIG. 5*d*, when the first and second drawstrings 136, 146 are intended to project from the second edge 118 of the bag 100, the fourth welding jaws 335 and the first welding jaws 345*a* may be combined so as to weld simultaneously the first and the second drawstring 136, 146 and the first edge 117. This especially produces a bag 100 as illustrated in FIG. 3*e*.

Optionally, and especially when the drawstring(s) 136, 146 are formed from heat-sealing material, the form-fill-seal machine 200, 300 may further comprise a device 220, 320 configured to form one of the notches 137, 147 (or clearances) on the film 1, in the zone of the film 1 intended to receive the ends 132, 134 of the channel 130 or the first end 132 of the first channel 130 and the second end 144 of the second channel 140. The device 220, 320 is preferably positioned between the device 210, 310 configured to guide the film 1 and the device 215, 315 configured to guide the drawstring(s) 136, 146.

The aim of these notches 137, 147 is to prevent welding of the drawstrings 136, 146 on the film 1, or even their cutting by the third or the first welding jaws 255, 345*a* during step S19 or S17 for welding the first and second sheets 112, 114 of the bag 100 so as to form the first edge 117 of the bag 100. Making the notch(es) 137, 147 in the film 1 in fact removes material at the ends 132, 134, 144 having to stay free of the channel(s) 130, 140 such that during welding of the first and second sheets 112, 114 of the bag 100 by the third welding jaws 255 or by the first welding jaws 345*a*, the effect of heat applied by the jaws 255, 345*a* is not to locally melt the film 1 and weld, or even cut, the end(s) 132, 134, 144 of the drawstring(s) 136, 146, ensuring that the drawstring(s) 136, 146 remain free of movement at these ends 132, 134, 144.

When the machine 200, 300 comprises a device 220, 320 configured to form a notch 137, 147 on the film 1 and the aim is for the drawstring 136 to protrude from the ends 132, 134 of the channel 130, the welding jaws 345*a*, 255 configured to weld the first edge 117 of the bag 100 may further have, in a welding face, notching configured to be opposite the notch 137, 147. It is evident in fact that when the drawstring 136 is formed from heat-sealable material, it is preferable to prevent its parts protruding from the channel 130 at the notch 137 not being cut by the welding jaws 345*a*, 255, when the latter weld the first sheet 112 onto the second sheet 114. By contrast, when the drawstring 136 is welded to itself, it is preferable to use conventional welding jaws 345*a*, 255 so as to simultaneously perform welding (step S17 or S19) of the first and of the second sheets 112, 114 and welding of the drawstring 136 to itself.

Second Embodiment: Longitudinal Fastening of the Closing Device 120

Figure 6B:
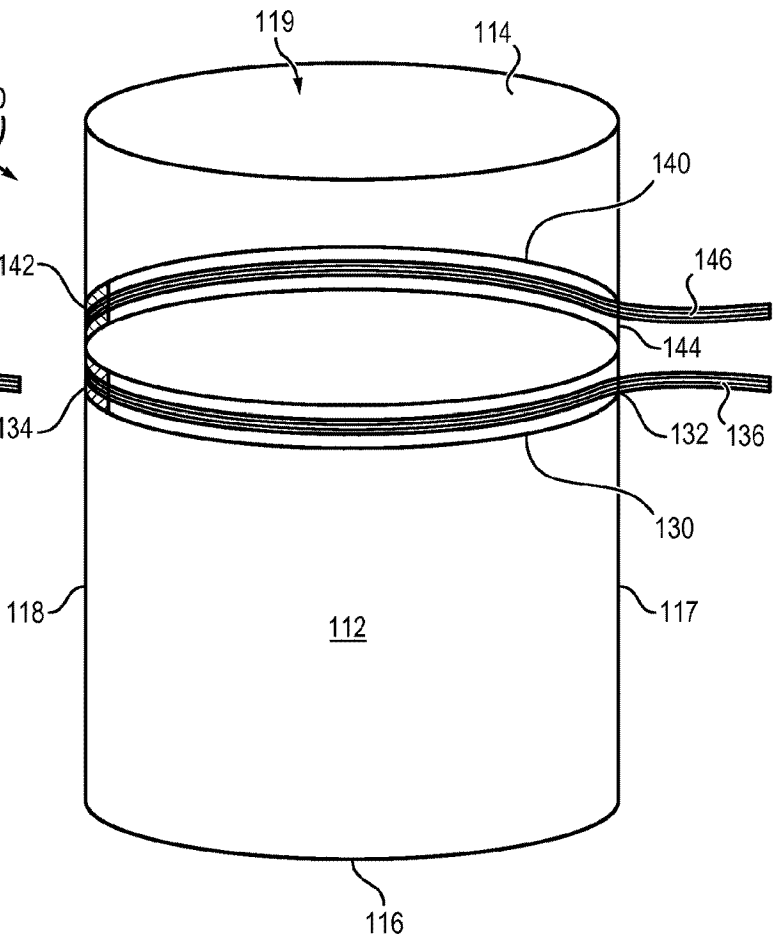
FIGS. 6*a* to 6*d* illustrate different examples of bags obtained by means of a form-fill-seal machine according to a second embodiment of the invention.
Figure 6A:
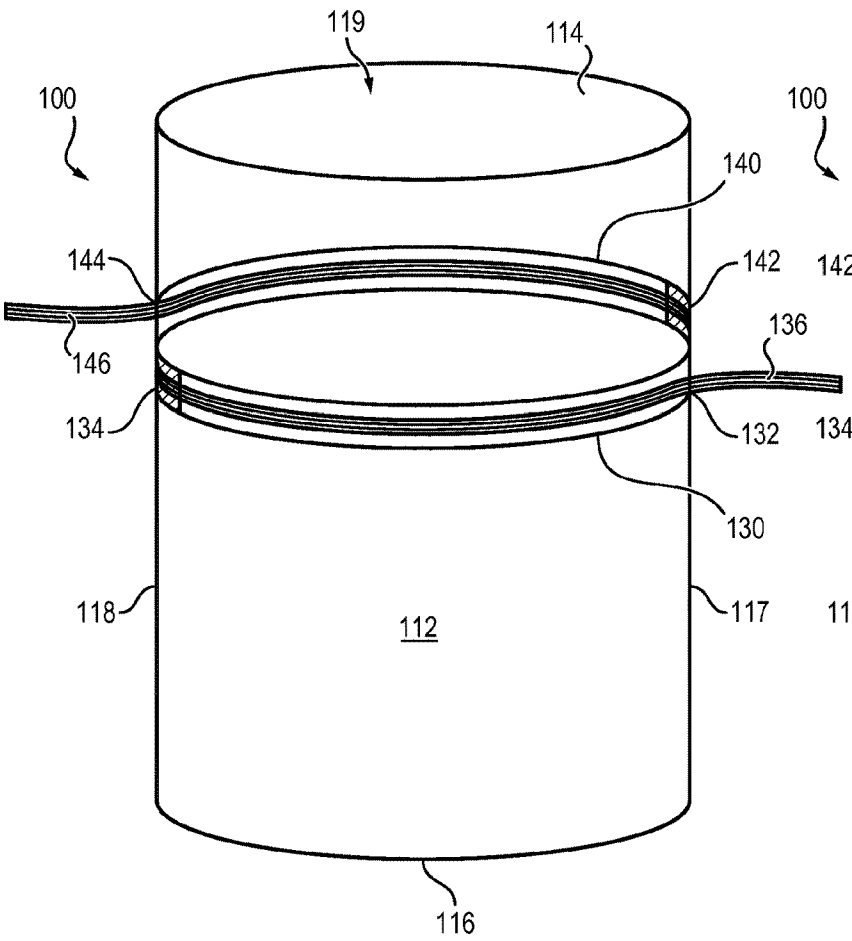
Figure 6D:
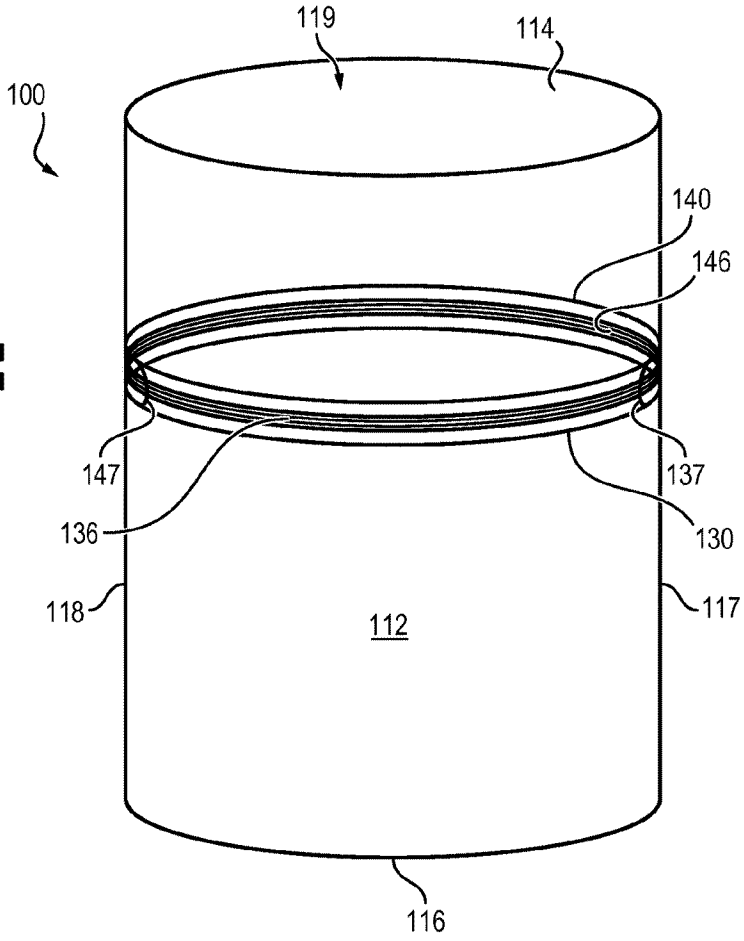
Figure 6C:
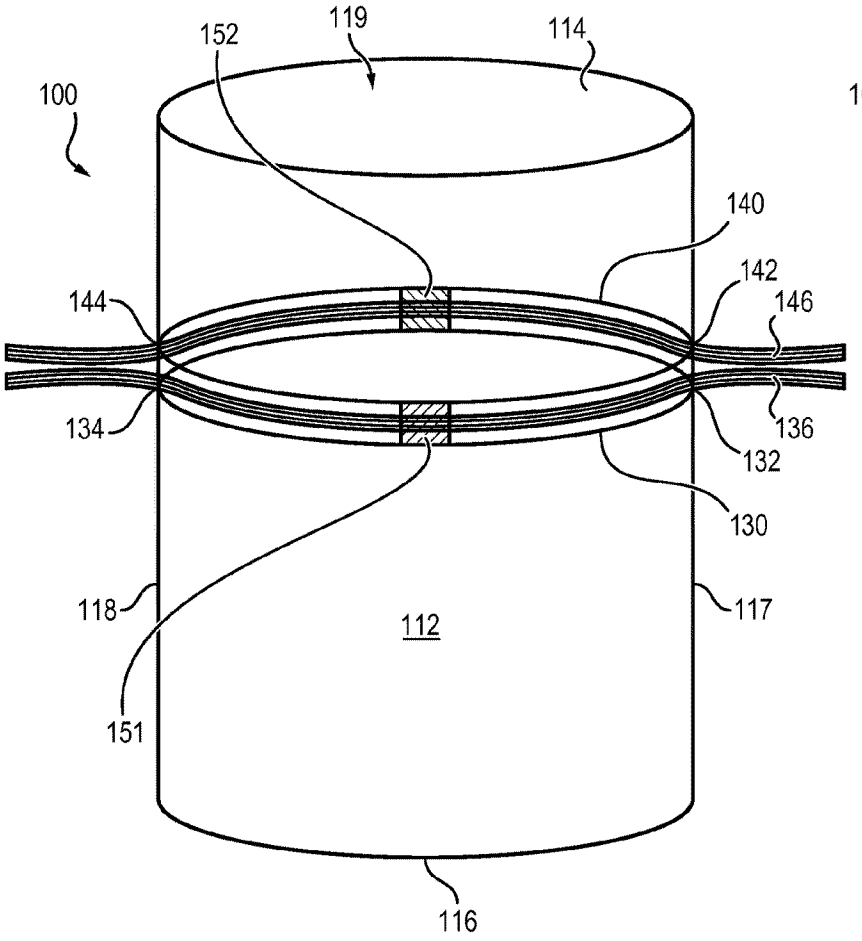
Figure 7:
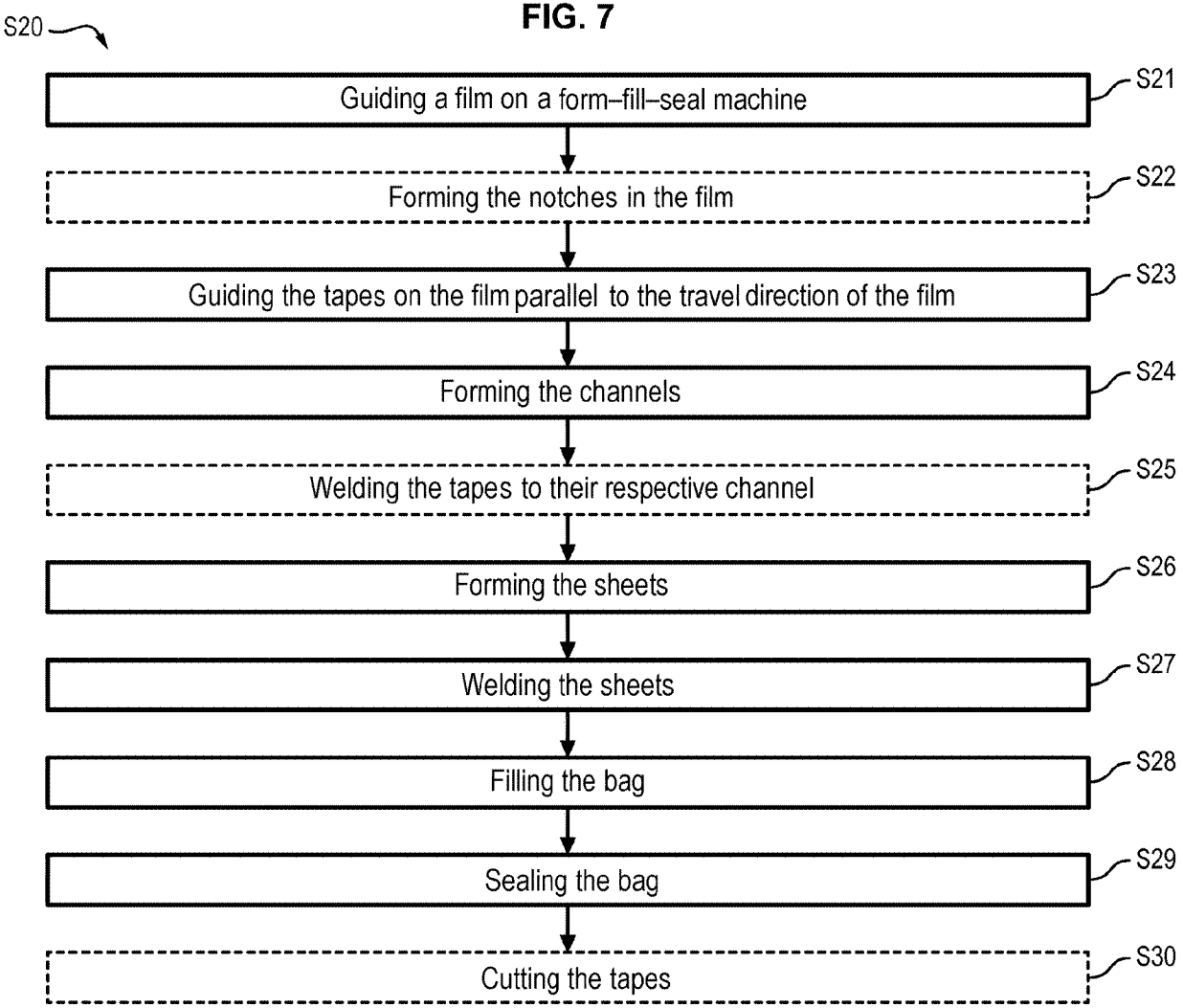
FIG. 7 is a flowchart of a method for implementing the form-fill-seal machine according to the second embodiment of the present invention.

FIGS. 6 to 8 illustrate several examples of a drawstring bag 100, a method S20 for manufacturing and filling a drawstring bag 100, and a form-fill-seal machine 400, 500 according to a second embodiment of the invention.

Examples of Drawstring Bag 100 According to the Second Embodiment

FIGS. 6*a* to 6*d* illustrate examples of drawstring bags 100 obtained according to a method S20 for manufacturing and filling a drawstring bag 100 according to a second embodiment of the invention.

Only those characteristics of the bag 100 which differ from the first embodiment of the invention will be detailed hereinbelow.

The bag 100 comprises a closing device 120 comprising:

- a first channel 130 and a second channel 140 extending between the edges 117, 118 of the bag, respectively on the first and the second sheets 112, 114, the first channel 130 and the second channel 140 each comprising a first end 132, 142 and a second end 134, 144, and
- a first drawstring 136, housed in the first channel 130, and a second drawstring 146, housed in the second channel 140, the first drawstring 136 protruding from the first end 132 of the first channel 130 and the second drawstring 146 protruding from the second end 144 of the second channel 140.

In the examples illustrated in FIGS. 6*a* to 6*c*, the first drawstring 136 is welded to the first channel 130 and the second drawstring 146 is welded to the second channel 140. It is clear that welding the drawstrings 136, 146 to their respective channel 130, 140 blocks the drawstrings 136, 146 in the channels 130, 140 without needing to form a knot at their free end.

In the examples illustrated in FIGS. 6*a* and 6*b*, the first drawstring 130 is welded in a zone adjacent to the second end 134 of the first channel 130 and the second drawstring 146 is welded in a zone adjacent to the first end 142 of the second channel 140. The drawstrings 136, 146 may be welded either directly at the free ends 132, 144 respectively, or at a short distance from these free ends 132, 144.

The first end 132 of the first channel 130 and the first end 142 of the second channel 140 may be adjacent to the first edge 117 of the bag 100, as illustrated in FIG. 6*a*. In this way, the first drawstring 136 and the second drawstring 146 protrude from their respective channel 130, 140 at an edge 117, 118 opposite the bag 100. Closing of the bag 100 is therefore done by pulling on the drawstrings 136, 146 in the extension of their respective channel 130, 140, in opposite directions. Those skilled in the art will understand that pulling on the emerging ends of each of the drawstrings 136, 146 easily achieves closing of the mouth 119.

The first end 132 of the first channel 130 and the second end 144 of the second channel 140 may also be adjacent to the first edge 117 of the bag 100, as illustrated in FIG. 6*b*. In this way, the first drawstring 136 and the second drawstring 146 protrude from their respective channel 130, 140 at the same edge 117 of the bag 100. Closing of the bag 100 is therefore done by pulling on the drawstrings 136, 146 in the extension of their respective channel 130, 140, in the same direction, by gripping the first edge 117 of the bag at which the drawstrings 136, 146 protrude.

In the example illustrated in FIG. 6*c*, the first drawstring 136 is welded to the channel 130 in a first zone 151 extending at a distance from the second end 134 of the first channel 130 and the second drawstring 146 is welded to the channel 140 in a second zone 152 extending at a distance from the first end 142 of the second channel 140. For example, the first zone 151 and the second zone 152 may extend in a central part of the first sheet 112 and of the second sheet 114, respectively. Also, the first zone 151 and the second zone 152 may be superposed, or be offset one relative to the other along the channels 130, 140.

In this exemplary embodiment, the first drawstring 136 also projects from the second end 134 of the first channel 103 whereas the second drawstring 146 also projects from the first end 142 of the second channel 140. Closing a bag 100 is therefore done by gripping the bag 100 in the first and the second zone 151, 152, at the fastening of the drawstrings 136, 146, and pulling on the free ends of the drawstrings 136, 146 (either simultaneously, at a first edge 117 of the bag 100 then at the second edge 118 of the bag 100). This closing is particularly easy to the extent where the distance to be covered by the edges 117, 118 to attain the closed configuration of the bag 100 is reduced (by half when the zones 151 and 152 are at the center of the channels 130, 140), which reduces both the time necessary for closing the bag 100 and the friction linked to folding of the sheets 112, 114. Opening may also be done either by pulling on the edges 117, 118 of the bag 100, or by holding the first 151 and the second 152 zone and by pulling on the first 117 then the second 118 edge of the bag 100. Here too, opening is simplified by separation of the channels 130, 140 into two parts by welding in the first 151 and the second zone 152.

In the examples illustrated in FIGS. 6*a* to 6*c*, the first channel 130 and the second channel 140 may be offset relative to each other according to the height of the bag 100, i.e., the second channel 140 may be closer to the mouth 119 of the bag 100 than the first channel 130, such that they are not superposed when the bag 100 is flattened. This offsetting of the first and second channels 130, 140, during closing of the bag 100 by pulling on the drawstrings 136, 146 in opposite directions, deforms the channels 130, 140 and therefore the mouth 119 by bringing the first channel 130 and the second channel 140 together. The consequence of this deformation is to accentuate folding of the sheets 112, 114 and therefore improve the sealing of the bag 100.

Alternatively, the first channel 130 and the second channel 140 may by contrast be superposed and not be offset relative to each other according to the height of the bag 100.

This in particular in the example of bag 100 is illustrated in FIG. 6*d*, wherein the bag 100 is further provided with notches 137, 147 (or clearances) made at the ends 132, 134, 142, 144 of the channels 130, 140, and the first and second drawstrings 136, 146 are welded to each other at each of the ends 132, 134, 142, 144 of the channels 130, 140. In this example, the length of the drawstrings 136, 146 corresponds overall to the length of their respective channel 130, 140.

Method S20 for Manufacturing and Filling Drawstring Bags 100 According to the Second Embodiment The bags 100 according to the second embodiment may be obtained on a so-called horizontal 400 (FIG. 9*a*) or vertical 500 (FIG. 9*b*) machine according to a manufacturing and filling method S20 comprising the following steps.

During a first step S21, a film 1 intended to form the sheets 112, 114 of the bag 100 is guided on a form-fill-seal machine 400, 500.

During a second step S22, optional, notches 137, 147 may be formed on the film, in the zone of the film intended to receive the ends 132, 134, 142, 144 of the channels 130, 140.

During a third step S23, a first and a second drawstring 136, 146 are guided on the film 1, parallel to a travel direction of the film 1.

Figures 8A, 8B, 8C:
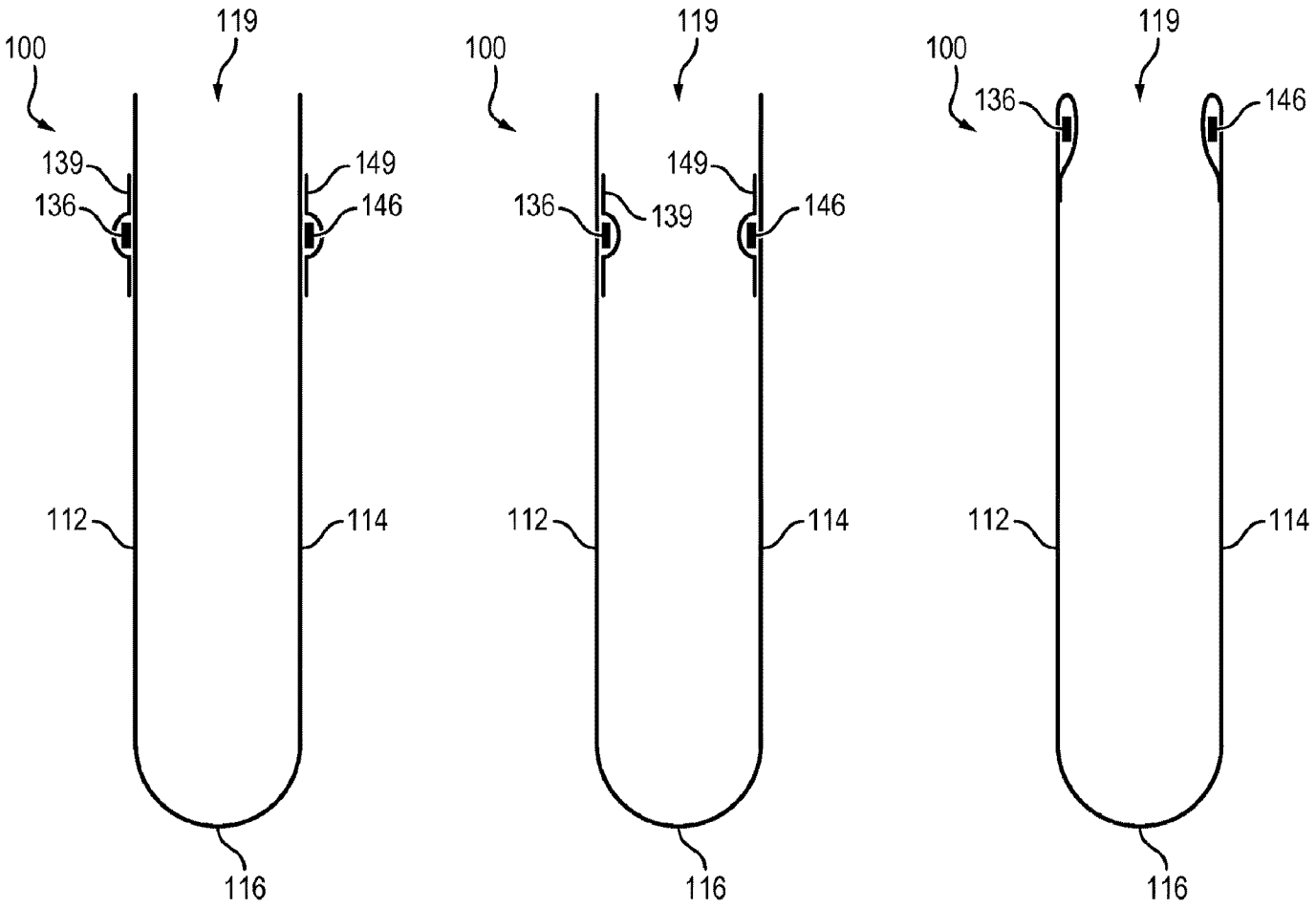
FIGS. 8*a* to 8*c* illustrate views in profile, section, of different examples of bags according to the second embodiment of the invention.

During a fourth step S24, the sides of the film 1 are folded back on themselves so as to form the first and second channels 130, 140, such that the channels 130, 140 extend parallel to the travel direction of the film 1. The sides of the film 1 are then welded to said film by ensuring one or two welding lines 131, 133; 141, 143 of the fold thus formed on the sheets 112, 114 to define between the welding lines 131, 133 and 141, 143 the channels 130, 140 (FIG. 8*c*).

As a variant, strips 139, 149 intended to form the first and second channels 130, 140 are attached and welded on the exterior (FIG. 8*a*) or on the interior (FIG. 8*b*) of the film 1, above the first and second drawstrings 136, 146, such that the channels 130, 140 extend parallel to the travel direction of the film 1.

During a fifth step S25, optional, the drawstrings 136, 146 may be welded to their respective channel 130, 140.

For this, the first drawstring 136 may for example be welded to a part of the first channel 130 intended to form the second end 134 of the first channel 130, and the second drawstring 146 may for example be welded to a part of the second channel 140 intended to form the first end 142 of the second channel 140. The parts intended to form the first end 132 of the first channel 130 and the first end 142 of the second channel 140 may be adjacent to the first edge 117 of the bag 100. As a variant, the parts intended to form the first end 132 of the first channel 130 and the second end 144 of the second channel 140 may be adjacent to the first edge 117 of the bag 100.

The first drawstring 136 may also be welded to the channel 130 in a first zone 151 extending at a distance from the second end 134 of the first channel 130 and the second drawstring 146 may be welded to the channel 140 in a second zone 152 extending at a distance from the first end 142 of the second channel 140.

As a variant, the first and the second drawstring 136, 146 may be left free to slide in their respective channel 130, 140.

During a sixth step S26, the film 1 provided with the first and second drawstrings 136, 146 is folded back on itself along a folding line extending in the travel direction of the film 1 so as to form the first and the second sheet 112, 114. The folding line defines the bottom 116 of the bag 100. In the second exemplary embodiment illustrated in FIG. 9*b*, wherein the form-fill-seal machine 500 is vertical, the film 1 is guided to a former to fold back the film 1 on itself.

At this stage, the bag 100 is open at three of these sides.

During a seventh step S27, the first and the second sheet 112, 114 are welded together, so as to close two of the three open sides of the bag 100.

Figure 9A:
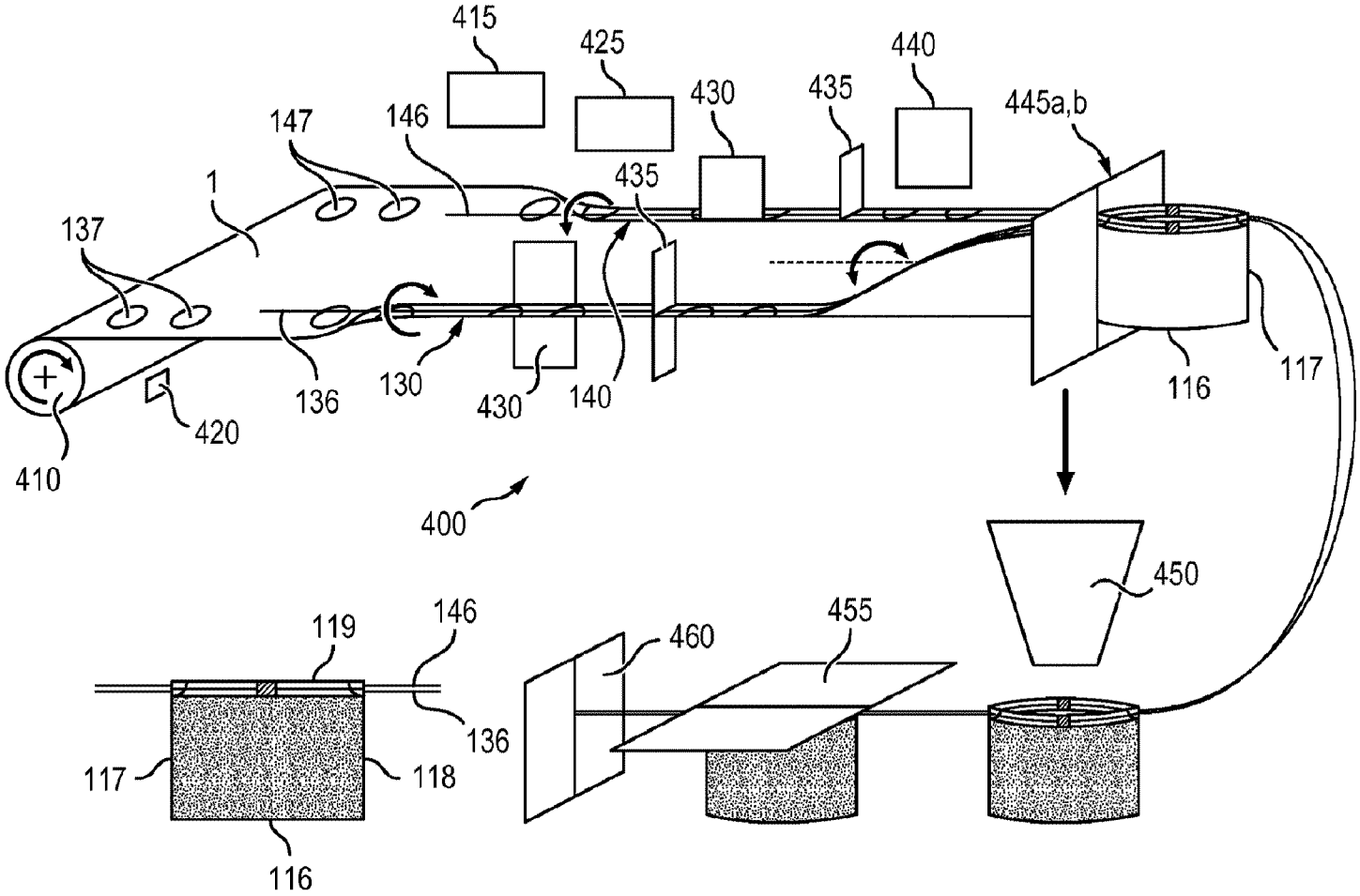
FIG. 9*a* illustrates a first example of a form-fill-seal machine according to the second embodiment of the invention.

In the first exemplary embodiment illustrated in FIG. 9*a*, the first and the second sheet 112, 114 are welded together in a direction perpendicular to the travel direction of the film 1 so as to form successively the first and the second edge 117, 118 of the bag 100 due to travel of the film. The welding of the first and second sheets 112, 114 together in fact simultaneously closes the second edge 118 of a given bag 100 and the first edge 117 of the bag 100 located downstream. At this stage of the method illustrated in FIG. 9*a*, the obtained bags 100 then have a bottom 116, a sealed first edge 117 and a sealed second edge 118, as well as an open mouth 119. The mouth 119 is further equipped with one or more drawstrings 136 housed in a channel 130, 140 and optionally welded to said channel 130, 140. In this first example, transversal welding of the first and second sheets 112, 114 so as to successively close the first and the second edge 117, 118 of the bag 100 may further weld the drawstrings 136, 146 together at the ends 132, 134, 142, 144 of the channels 130, 140 (see FIG. 6*d*). Transversal welding of the first and second sheets 112, 114 so as to close the first and the second edge 117, 118 of the bag 100 may further weld the second drawstring 146 to the second channel 140 and the first drawstring 136 to the first channel 130 respectively at the first and second edges 117, 118 (see FIG. 6*a*).

Figure 9B:
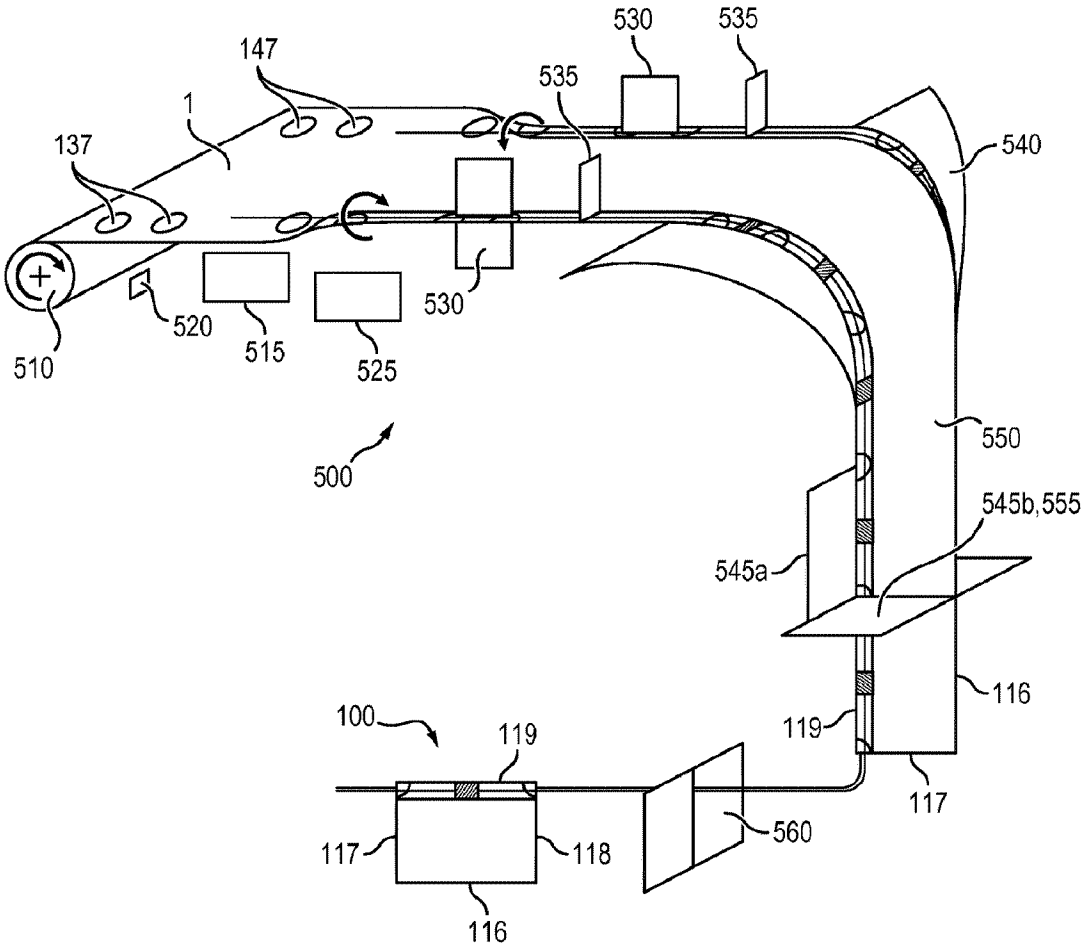
FIG. 9*b* illustrates a second example of a form-fill-seal machine according to the second embodiment of the invention.

In the second exemplary embodiment illustrated in FIG. 9*b*, the first and the second sheet 112, 114 are welded successively together along a longitudinal welding closing the mouth 119 of the bag 100 in a direction parallel to the travel direction of the film, then along transverse welding closing the first edge 117 of the bag 100 in a direction perpendicular to the direction of the film 1. Transverse welding of the first edge 117 of the bag 100 further seals, due to travel of the film 1, the second edge 118 of the bag 100 located downstream. At this stage of the method illustrated in FIG. 9*b*, the obtained bags 100 thus have a bottom 116 formed by the fold of the bag 100, a sealed first edge 117 and a sealed mouth 119, as well as an open second edge 118. The mouth 119 is further equipped with one or more drawstrings 136 housed in a channel 130, 140 and optionally welded to said channel 130, 140.

In this second example, transversal welding of the first and second sheets 112, 114 so as to close the first edge 117 of the bag 100 may further weld the drawstrings 136, 146 together at the ends 132, 142 of the channels 130, 140 adjacent to the first edge 117 (see FIG. 6*d*). Transversal welding of the first and second sheets 112, 114 so as to close the first edge 117 of the bag 100 may further weld the second drawstring 146 to the second channel 140 at the first edge 117 (see FIG. 6*a*).

In the first and second exemplary embodiments (FIG. 9*a*, FIG. 9*b*), the drawstrings 136, 146 are not cut during the seventh step S27. In this way, when the bag 100 detaches from the film 1, the drawstrings 136, 146 housed in their respective channel 130, 140 protrude from the edges 117, 118 of the bag 100 and remain housed in the channels 130, 140 formed on the film 1 for the downstream bag 100.

The sixth and seventh steps S26, S27 thus form the bag 100 in this way.

During an eighth step S28, the bag 100 is filled via the last of the sides of the bag 100 still open. In the first exemplary embodiment (FIG. 9*a*), the bag 100 is filled via the side intended to form the mouth 119 of the bag 100, whereas in the second exemplary embodiment (see FIG. 9*b*), the bag 100 is filled via the side intended to form the second edge 118 of the bag 100.

During a ninth step S29, the first and the second sheet 112, 114 are welded together so as to close the last of the sides of the bag 100 still open and thereby seal the bag 100.

In the first exemplary embodiment (see FIG. 9*a*), the first and the second sheet 112, 114 are welded together so as to form the mouth 119 of the bag 100 according to a longitudinal welding, whereas in the second exemplary embodiment (see FIG. 9*b*), the first and the second sheet 112, 114 are welded together so as to form the second edge 118 of the bag 100 according to a transverse welding. In this last case, during the ninth step S9 the drawstrings 136, 146 may be cut and welded to each other at the ends 134, 144 of the channels 130, 140 adjacent to the second edge 118 (see FIG. 6*d*). Transversal welding of the first and second sheets 112, 114 so as to close the second edge 118 of the bag 100 may further weld the first drawstring 136 to the first channel 130 at the second edge 118 (see FIG. 6*a*).

During a tenth step S30, optional, the first and the second drawstring 136, 146 are cut such that the free ends of the drawstrings 136, 146 protrude from the edge(s) 117, 118 of the bag 100 (FIGS. 6*a* to 6*c*). The drawstrings 136, 146 are for example cut hot, when the drawstrings 136, 146 are made of heat-sealing material.

As a variant, the tenth step S30 may occur after the filling step S28 of the bag 100 and before the sealing step S29 of the bag 100.

Form-Fill-Seal Machine 400, 500 According to the Second Embodiment

The bags 100 may be obtained by means of a form-fill-seal machine 400, 500 comprising:

- a device 410, 510 configured to guide a film 1 on the form-fill-seal machine 400, 500,
- a conveying device 415, 515 configured to guide a first and a second drawstring 136, 146 on the film 1, parallel to a travel direction of the film 1, such that the first drawstring 136 is adjacent to a first side of the film 1 and the second drawstring 146 is adjacent to a second side of the film 1,
- a device 425, 525 configured to form the first channel 130 and the second channel 140 on the film 1. The device 425, 525 is for example configured to fold back on themselves the sides of the film 1 so as to form the first and second channels 130, 140, such that the channels 130, 140 extend parallel to the travel direction of the film 1. The device 425, 525 may also be configured to apply strips 139, 149 intended to form the channels 130, 140 on the exterior or on the interior of the film 1, above the drawstrings 136, 146, such that the channels 130, 140 extend parallel to the travel direction of the film 1,
- welding bars 430, 530 configured to weld the first channel 130 and the second channel 140 on the film 1, especially to weld the folded-back sides of the film 1 or the strips 139, 149 attached on the film 1 above the drawstrings 136, 146,
- a folding device 440, 540 to fold back the film 1 on itself, along a folding line extending in the travel direction of the film 1 so as to form the first 112 and the second 114 sheets. In particular, in the second exemplary embodiment illustrated in FIG. 9*b*, the folding device 540 comprises a former,
- first and second welding jaws 445*a*, 445*b*; 545*a*, 545*b* configured to weld the first sheet 112 on the second sheet 114 and respectively form the first and the second edge 117, 118 (FIG. 9*a*) or the mouth 119 and the second edge 118 (FIG. 9*b*),
- a filling chute 450, 550 configured to fill the bag 100 by the side still open, and
- third welding jaws 455, 555 configured to seal the bag 100 by closing the side still open.

In the case of the method illustrated in FIG. 9*a*, the first and second welding jaws 445*a*, 445*b* may be combined and configured to weld successively the first and the second edge 117, 118 of the bag 100 due to travel of the bag 100 in the machine 200.

In the case of the method illustrated in FIG. 9*b*, the second and the third welding jaws 545*b*, 555 may be combined and configured to weld successively the second edge 118 and the first edge 117 of the bag 100 due to travel of the bag 100 in the machine 200.

Optionally, the form-fill-seal machine 400, 500 may comprise fourth welding jaws 435, 535 configured to weld the first drawstring 136 to the first channel 130 and the second drawstring 146 to the second channel 140.

In the case of the method illustrated in FIG. 9*a*, the fourth welding jaws 435 may be combined with the first and second welding jaws 445*a* and 445*b*.

In the case of the method illustrated in FIG. 9*b*, the fourth welding jaws 535 may be combined with the second and the third welding jaws 545*b*, 555.

Optionally, the form-fill-seal machine 400, 500 may further comprise a device 420, 520 configured to form one or more notches 137, 147 (or clearances) on the film 1, in the zone of the film 1 intended to receive the first end 132 of the first channel 130 and the second end 144 of the second channel 140. The device 420, 520 is then preferably positioned between the device 410, 510 configured to guide the film 1 and the device 415, 515 configured to guide the drawstring(s) 136, 146.

Similarly to the first embodiment, the object of the notches 137, 147 is to prevent welding or cutting of the drawstrings 136, 146 on the film 1, during welding steps S27 and/or S29. Similarly, when the machine 400, 500 comprises a device 420, 520 configured to form notches 137, 147 on the film 1 and when one wishes the drawstrings 136, 146 to protrude from the ends 132, 144 or 132, 134, 142, 144 of their respective channel 130, 140, the first and/or second welding jaws 445*a*, 445*b* or even the third welding jaws 555 may further have, in a welding face, notching configured to be opposite the notches 137, 147.

Optionally, the form-fill-seal machine 400, 500 may comprise a cutting device 460, 560 configured to cut the first and/or the second drawstring 136, 146.

The invention claimed is:

1. A form-fill-seal machine (200, 300, 400, 500) for manufacturing and filling a bag (100) provided with a drawstring, said bag including a first sheet (112) and a second sheet (114) forming together a first edge (117) and a second edge (118) of the bag, and a closing device (120) including a drawstring, the form-fill-seal machine comprising:

a device (210, 310, 410, 510) configured to guide a film (1) on the machine, a conveying device (215, 315, 415, 515) configured to position at least one drawstring (136, 146) on the film, a folding device (240, 340, 440, 540) configured to fold the film (1) so as to form the first sheet (112) and the second sheet (114) of the bag, first and second welding jaws (245*a-b*, 345*a-b*, 445*a-b*, 545*a-b*) configured to weld the first sheet (112) and the second sheet (114) so as to close two sides of the bag and leave a third side of the bag open, a filling chute (250, 350, 450, 550) configured to fill the bag by the third side of the bag, and third welding jaws (255, 355, 455, 555) configured to close the bag by sealing the third side, wherein the conveying device (215, 315, 415, 515) is configured to position the drawstring (136, 146) on the film in a direction transversal to a travel direction of the film (1).

2. The machine (300) according to claim 1, wherein:

the folding device (340) comprises a former, the first welding jaws (345*a*) are configured to weld the first edge (117) of the bag, and the second and third welding jaws (345*b*, 355) are combined and configured to weld successively a bottom (116) and a mouth (119) of the bag.

3. The machine (300) according to claim 2, wherein the conveying device (315) is configured to position two drawstrings (136, 146) on the film (1), said drawstrings extending substantially parallel relative to each other.

4. The machine (300) according to claim 3, wherein the conveying device (315) is configured to position the drawstrings (136, 146) on the film (1) such that the first drawstring (136) is adjacent to a first side of the film and the second drawstring (146) is adjacent to a second side of the film, the first drawstring (136) and the second drawstring (146) being of length substantially equal to half the width of the film, such that the first drawstring and the second drawstring are substantially offset relative to each other in a direction perpendicular to the travel direction of the film.

5. The machine (300) according to claim 4, further comprising a device (320) configured to form a first notch (137) in the first side of the film in a zone of the film intended to receive the first drawstring (136), and a second notch (147) in a central zone of the film, in a zone of the film intended to receive the second drawstring (146), such that during folding of the film (1) by the folding device (340), the first notch (137) is located at the first edge (117) of the bag and the second notch (147) is located at the second edge (118) of the bag.

6. The machine (300) according to claim 3, further comprising fourth welding jaws (335) configured to weld the first drawstring (136) on the second edge (118) of the bag and the second drawstring (146) on the first edge (117) of the bag.

7. The machine (300) according to claim 2, wherein:

the conveying device (315) is configured to position the drawstring (136) on the film (1) such that said drawstring protrudes on either side of said film, and the folding device (340) is configured to fold the film (1) such that the free ends of the drawstring (136) are adjacent.

8. The machine (200, 300) according to claim 7, further comprising fourth welding jaws (235, 335) configured to weld the drawstring (136) to the film (1):

either at a zone of the film intended to form the second edge (118) of the bag, so as to weld the drawstring (136) both on the second sheet (114) and on the first sheet (112), or in a zone of the film intended to form the first edge (117) of the bag, the drawstring (136) not being fixed on the second sheet (114).

9. The machine (200, 300) according to claim 8, wherein the fourth welding jaws (235, 335) and the first welding jaws (245*a*) or the third welding jaws (355) are combined and are configured to weld the drawstring (136) on the first sheet (112) at the first edge (117) of the bag, the drawstring not being fixed on the second sheet (114).

10. A form-fill-seal machine (200, 300, 400, 500) for manufacturing and filling a bag (100) provided with a drawstring, said bag including a first sheet (112) and a second sheet (114) forming together a first edge (117) and a second edge (118) of the bag, and a closing device (120) including a drawstring, the form-fill-seal machine comprising:

a device (210, 310, 410, 510) configured to guide a film (1) on the machine, a conveying device (215, 315, 415, 515) configured to position at least one drawstring (136, 146) on the film.

11. The machine (200) according to claim 10, wherein:

the folding device (240) is configured to form the second edge (118) of the bag, and the first and the second welding jaws (245*a*, 245*b*) are combined and configured to weld successively a bottom (116) and a mouth (119) of the bag, and the third welding jaws (255) are configured to weld the first edge (117) of the bag.

a folding device (240, 340, 440, 540) configured to fold the film (1) so as to form the first sheet (112) and the second sheet (114) of the bag, first and second welding jaws (245*a-b*, 345*a-b*, 445*a-b*, 545*a-b*) configured to weld the first sheet (112) and the second sheet (114) so as to close two sides of the bag and leave a third side of the bag open, a filling chute (250, 350. 450, 550) configured to fill the bag by the third side of the bag, and third welding jaws (255, 355, 455, 555) configured to close the bag by sealing the third side, wherein the conveying device (415, 515) is configured to position two drawstrings (136, 146) on the film (1), said drawstrings extending substantially parallel relative to each other in the travel direction of the film, such that the first drawstring (136) is adjacent to a first side of the film (1) and the second drawstring (146) is adjacent to a second side of the film (1)

further comprising fourth welding jaws (435, 535) configured to weld:

either the first drawstring (136) on the second edge (118) of the bag and the second drawstring (146) on the first edge (117) of the bag, or the first drawstring (136) and the second drawstring (146) together, or the first drawstring (136) and the second drawstring (146) on the second edge (118) of the bag, or the first drawstring (136) in a zone at a distance from the second edge (118) of the bag and the second drawstring (146) in a zone at a distance from the first edge (117) of the bag.

12. The machine (500) according to claim 10, wherein:
the folding device (540) comprises a former,
the first welding jaws (545*a*) are configured to weld a mouth (119) of the bag, and
the second and the third welding jaws (545*b*, 555) are combined and are configured to weld successively the first edge (117) of the bag and the second edge (118) of the bag.

13. The machine (400) according to claim 10, wherein:
the folding device (440) is configured to form a bottom (116) of the bag, and
the first and the second welding jaws (445*a*, 445*b*) are combined and are configured to weld successively the first edge (117) and the second edge (118) of the bag, and
the third welding jaws (455) are configured to weld the mouth (119) of the bag.

14. The machine (400, 500) according to claim 10, wherein the fourth welding jaws (435, 535) are combined with the first or the second welding jaws (445*a*, 445*b*) or are combined with the second or the third welding jaws (545*b*, 555).

15. A method (S10, S20) for manufacturing and filling a bag (100) provided with a drawstring by means of a form-fill-seal machine (200, 300, 400, 500), said bag comprising a first sheet (112) and a second sheet (114) forming together a first edge (117) and a second edge (118) of the bag, and a closing device (120) including a drawstring, the manufacturing and filling method comprising the following steps:
guiding (S11, S21) a film (1) on the machine,
positioning (S13, S23) at least one drawstring (136, 146) on the film,
folding (S16, S26) the film (1) so as to form the first sheet (112) and the second sheet (114) of the bag,
welding (S17, S27) the first sheet (112) and the second sheet (114) so as to close two sides of the bag and leave a third side of the bag open,
filling (S18, S28) the bag (100) via the third side of the bag, and
closing (S19, S29) the bag (100) by sealing the third side
wherein the drawstring (136, 146) is positioned (S13) on the film in a direction transversal to a travel direction of the film (1).

16. The method (S10) according to claim 15, wherein
the film (1) is folded (S16) so as to form the second edge (118) of the bag,
the first and the second sheets (112, 114) are welded (S17) so as to form the first edge (117) and a bottom (116) of the bag,
the bag is closed (S19) by sealing the mouth (119) of the bag.

17. The method (S10) according to claim 16, wherein two drawstrings (136, 146) are positioned (S13) on the film (1), said drawstrings extending substantially parallel relative to each other.

18. The method (S10) according to claim 17, wherein the drawstrings (136, 146) are positioned (S13) on the film (1) such that the first drawstring (136) is adjacent to a first side of the film and the second drawstring (146) is adjacent to a second side of the film, the first drawstring and the second drawstring being of length substantially equal to half the width of the film, such that the first drawstring and the second drawstring are substantially offset relative to each other in a direction perpendicular to the travel direction of the film.

19. The method (S10) according to claim 18, wherein a first notch (137) is formed (S12) in the first side of the film (1) in a zone of the film intended to receive the first drawstring (136), and a second notch (147) is formed (S12) in a central zone of the film (1), in a zone of the film intended to receive the second drawstring (146), such that during folding (S16) of the film, the first notch (137) is located at the first edge (117) of the bag and the second notch (147) is located at the second edge (118) of the bag.

20. The method (S10) according to claim 17, wherein the first drawstring (136) is welded (S15) on the second edge (118) of the bag and the second drawstring (146) is welded (S15) on the first edge (117) of the bag.

21. The method (S10) according to claim 16, wherein the drawstring (136) is positioned (S13) on the film (1) such that said drawstring protrudes on either side of said film, and the film is folded (S16) such that the free ends of the drawstring are adjacent.

22. The method (S10) according to claim 21, wherein the drawstring (136) is welded (S15) to the film (1):
either at a zone of the film (1) intended to form the second edge (118) of the bag, so as to weld the drawstring (136) both on the second sheet (114) and on the first sheet (112),
or in a zone of the film (1) intended to form the first edge (117) of the bag, the drawstring (136) not being fixed on the second sheet (114).

23. The method (S10) according to claim 22, wherein the welding (S15) of the drawstring (136) occurs simultaneously with welding (S17) of the first and of the second sheets (112, 114) so as to weld the drawstring on the first sheet (112) at the first edge (117) of the bag, the drawstring not being fixed on the second sheet (114).

24. The method (S10) according to claim 15, wherein:
the film (1) is folded (S16) so as to form the second edge (118) of the bag, and
the first and the second sheets (112, 114) are welded (S17) so as to form a bottom (116) and a mouth (119) of the bag, and
the bag is closed (S19) by sealing the first edge (117) of the bag.

* * * * *